US010443785B2

(12) United States Patent
Song et al.

(10) Patent No.: US 10,443,785 B2
(45) Date of Patent: Oct. 15, 2019

(54) METHOD AND SYSTEM FOR OPTIMIZING THE FILLING, STORAGE AND DISPENSING OF CARBON DIOXIDE FROM MULTIPLE CONTAINERS WITHOUT OVERPRESSURIZATION

(71) Applicants: Xuemei Song, East Amherst, NY (US); Shawn M Cecula, Niagara Falls, NY (US)

(72) Inventors: Xuemei Song, East Amherst, NY (US); Shawn M Cecula, Niagara Falls, NY (US)

(73) Assignee: PRAXAIR TECHNOLOGY, INC., Danbury, CT (US)

( * ) Notice: Subject to any disclaimer, the term of this patent is extended or adjusted under 35 U.S.C. 154(b) by 244 days.

(21) Appl. No.: 15/472,997

(22) Filed: Mar. 29, 2017

(65) Prior Publication Data

US 2017/0284603 A1 Oct. 5, 2017

Related U.S. Application Data

(60) Provisional application No. 62/315,434, filed on Mar. 30, 2016, provisional application No. 62/438,746, filed on Dec. 23, 2016.

(51) Int. Cl.
*F17C 5/06* (2006.01)
*F17C 7/04* (2006.01)
(Continued)

(52) U.S. Cl.
CPC ..... *F17C 5/06* (2013.01); *F17C 1/00* (2013.01); *F17C 1/005* (2013.01); *F17C 5/005* (2013.01);
(Continued)

(58) Field of Classification Search
CPC .... F17C 5/06; F17C 7/04; F17C 5/005; F17C 13/002; F17C 7/00; F17C 1/005;
(Continued)

(56) References Cited

U.S. PATENT DOCUMENTS 4,100,537 A 7/1978 Carlson
4,936,343 A 6/1990 Pruitt et al.
(Continued)

FOREIGN PATENT DOCUMENTS

WO 2015153580 A1 10/2015

*Primary Examiner* — Randy W Gibson
*Assistant Examiner* — Gedeon M Kidanu
(74) *Attorney, Agent, or Firm* — Nilay S. Dalal

(57) ABSTRACT

This invention relates to a novel method and system for dispensing CO2 vapor without over pressurization. The system includes one or more liquid containers and one or more vapor containers. The system is designed to operate in a specific manner whereby a restricted amount of CO2 liquid is permitted into the vapor container through a restrictive pathway that is created and maintained by a shuttle valve during the filling operation so that equalization of container pressures is achieved, thereby allowing shuttle valve to reseat when filling has stopped. During use, a pressure differential device is designed to specifically isolate the vapor container from the liquid container so as to preferentially deplete liquid CO2 from the vapor container and avoid over pressurization of the system until the vapor container. The system is operated so that at least 50% of the CO2 product is dispensed from the vapor container. The system also includes novel control methodology for performing pre-fill integrity checks to ensure safety of subsequent dispensing of CO2 liquid from a source vessel to the onsite CO2 containers.

21 Claims, 10 Drawing Sheets

CO2 storage and dispensing two cylinder system

(51) Int. Cl.

| | |
|---|---|
| ***F17C 1/00*** | (2006.01) |
| ***F17C 7/00*** | (2006.01) |
| ***F17C 13/00*** | (2006.01) |
| ***F17C 5/00*** | (2006.01) |
| ***B67D 1/04*** | (2006.01) |

(52) U.S. Cl.

CPC ..... *F17C 7/00* (2013.01); *F17C 7/04* (2013.01); *F17C 13/002* (2013.01); *B67D 1/04* (2013.01); *F17C 2203/0639* (2013.01); *F17C 2203/0646* (2013.01); *F17C 2203/0648* (2013.01); *F17C 2205/0138* (2013.01); *F17C 2205/0323* (2013.01); *F17C 2205/0338* (2013.01); *F17C 2205/0382* (2013.01); *F17C 2221/013* (2013.01); *F17C 2223/0153* (2013.01); *F17C 2223/035* (2013.01); *F17C 2225/0123* (2013.01); *F17C 2227/043* (2013.01); *F17C 2260/021* (2013.01); *F17C 2260/022* (2013.01); *F17C 2260/042* (2013.01); *F17C 2270/0171* (2013.01); *F17C 2270/059* (2013.01); *F17C 2270/0509* (2013.01); *F17C 2270/07* (2013.01); *F17C 2270/0736* (2013.01)

(58) Field of Classification Search

CPC ..... F17C 1/00; F17C 2270/0736; F17C 2270/0171; F17C 2205/0382; F17C 2203/0648; F17C 2203/0646; F17C 2270/0509; F17C 2003/0639; F17C 2205/0138; F17C 2205/0323; F17C 2205/0338; F17C 2221/013; F17C 2223/0153; F17C 2223/035; F17C 2225/0123; F17C 2227/043; F17C 2260/021; F17C 2260/022; F17C 2260/042; F17C 2270/07; F17C 2270/059; B67D 1/04

See application file for complete search history.

(56) References Cited

U.S. PATENT DOCUMENTS

| | | | | |
|---|---|---|---|---|
| 5,113,905 | A | 5/1992 | Pruitt et al. | |
| 6,817,385 | B1 * | 11/2004 | Sloan | B65B 1/04 137/885 |
| 7,258,127 | B1 * | 8/2007 | Schneider | F17C 13/04 137/109 |
| 7,766,309 | B1 * | 8/2010 | Smythe | F16K 11/044 261/62 |
| 8,757,437 | B2 * | 6/2014 | Schneider | B67D 1/04 222/129.1 |
| 8,844,555 | B2 * | 9/2014 | Schneider | B67D 1/0057 137/107 |
| 2010/0230436 | A1 * | 9/2010 | O'Donnell | F17C 7/00 222/63 |
| 2015/0010839 | A1 * | 1/2015 | Yoshida | F17C 5/007 429/429 |
| 2015/0020917 | A1 * | 1/2015 | Makinson | F17C 5/02 141/4 |
| 2017/0023179 | A1 * | 1/2017 | Schneider | F17C 5/02 |

* cited by examiner

CO2 storage and dispensing two cylinder system

Connect to liquid cyl
Pressure differential device integrated with shuttle valve Vapor product consumption from a conventional liquid and cylinder system Vapor product consumption from a liquid and vapor cylinder system of the present invention

METHOD AND SYSTEM FOR OPTIMIZING THE FILLING, STORAGE AND DISPENSING OF CARBON DIOXIDE FROM MULTIPLE CONTAINERS WITHOUT OVERPRESSURIZATION

RELATED APPLICATIONS

The present application claims priority to U.S. Application Ser. No. 62/315,434 filed Mar. 30, 2016 and U.S. Application Ser. No. 62/438,746 filed Dec. 23, 2016, the disclosures of which are hereby incorporated by reference in their respective entireties for all purposes.

FIELD OF THE INVENTION

This invention relates to a novel method and system for delivery of carbon dioxide from multiple containers to an-end-user or customer point of use for a variety of applications. Additionally, the invention relates to an automated system for performing certain integrity checks prior to filling of carbon dioxide into one or more container.

BACKGROUND OF THE INVENTION

Carbon dioxide (CO2) storage and dispensing systems have been used for a variety of applications, including, by way of example, on-site beverage dispensing applications, such as a carbonated beverage dispenser. The beverage industry uses CO2 to carbonate and/or transport beverages from a storage tank to a specified dispensing area. By example, beverages such as beer can be contained in kegs in the basement or storage room and the taps at the bar can dispense the beer. The storage and delivery of beer from the kegs can occur in a keg area that is located away from where the patrons are sitting. In order to transport the beer from the keg area to the serving area, CO2 has generally been delivered as a liquid in cylinders. The liquid CO2 cylinders are connected to the kegs, which can comprise one or several tanks or barrels. CO2 in the liquid CO2 cylinders is not completely filled with liquid, thereby allowing the carbon dioxide to vaporize into a gaseous state, which is then used to carbonate as well as move the desired beverage from the storage room or basement to the delivery area and provide much of the carbonation to the beverages.

Today, the usage of CO2 storage and dispensing systems is widespread. Many conventional CO2 storage and dispensing systems utilize low pressure dewars (e.g., vacuum insulated jacketed container) which are typically considered a low pressure storage and dispensing system that is filled to no greater than about 300 psig. Notwithstanding the vacuum insulation, the cold CO2 fluid that fills into a liquid CO2 dewar increases in temperature and vaporizes as heat is gained by the dewar. The vapor generates a higher pressure in the dewar, which may require venting to avoid over pressurization. As such, dewar usage is undesirable as it can increase CO2 products losses arising from the need to periodically vent the excess pressure to avoid over pressurization.

As an alternative to dewars, high pressure uninsulated CO2 storage and dispensing systems have been employed in an attempt to increase CO2 product utilization. However, current high pressure uninsulated CO2 liquid storage and dispensing systems can increase the risk of over pressurization. For example, the maximum permitted filling capability for an uninsulated CO2 liquid cylinder is 68 wt % of total weight (based on water weight). In other words, the system should not be filled to more than 68 wt % by water weight. As temperature increases, the liquid CO2 can vaporize into the headspace and expand to a point where the maximum working pressure of the cylinder is exceeded, thereby potentially rupturing the cylinder.

As a means to control the amount of liquid CO2 filled in uninsulated cylinders, multiple cylinders employing liquid and vapor cylinders have been used. A 2:1 volume ratio for the volume of liquid cylinder to vapor cylinder has been generally regarded as safe operating practice within the industry. Specifically, at the 2:1 volume ratio, the volume of the vapor cylinder and an additional 10% headspace in the liquid cylinder in which the liquid cylinders are deemed to be maximally filled as defined above can create approximately 40% headspace by volume of the combined capacity of the liquid and vapor cylinders. However, this methodology of determining when the system is full poses the risk of overfilling the CO2 liquid containers. Overfilling can also result in the system not operating properly and lead to erratic supply of CO2 vapor product to a customer or end-user.

In view of such drawbacks, there is a need for an improved method and high pressure system for optimizing CO2 filling, storage and dispensing that is not prone to over pressurization.

SUMMARY OF THE INVENTION

As will be described herein, the present invention employs a pressure differential device with shuttle valve between the liquid and vapor CO2 containers to maintain a higher pressure in the liquid container relative to the vapor container during filing and subsequent supply of CO2 vapor product from the vapor container to the customer. During CO2 vapor product supply to the customer, vapor transfer from the liquid container to the vapor container is limited until the pressure in the vapor container drops to below the differential pressure set point. This arrangement will preferentially deplete liquid from the vapor container versus vapor transfer from the liquid container, thereby mitigating the potential of over pressurization of the on-site system. The on-site system as used herein can be advantageously assembled on-site at the end-user or customer premises.

In a first aspect, a CO2 safety interlock fill system configured to perform pre-fill integrity checks for automatically leak checking a fill manifold and pressurizing the fill manifold, said pre-fill integrity checks for the leak checking and the pressurizing of the fill manifold performed prior to the CO2 safety interlock fill system allowing a subsequent filling operation of liquefied carbon dioxide (CO2) product into a container from an onsite CO2 source, said CO2 safety interlock fill system comprising: the onsite CO2 source, said onsite CO2 source comprising a source vessel containing liquefied CO2, and vaporized CO2 in a headspace of the source vessel; a fill manifold operably connected to the source vessel, said fill manifold comprising one or more conduits positioned between the source vessel and the container, said one or more conduits comprising at least a CO2 vapor supply conduit extending into the headspace of the source vessel of the onsite CO2 source; said fill manifold further comprising at least one pressure transducer situated along the one or more conduits, said CO2 vapor supply conduit of the fill manifold configured to receive a finite amount of the vaporized CO2 during the pressurization and leak checking of the fill manifold, said CO2 vapor supply conduit receiving the vaporized CO2 from the headspace of the source vessel of the onsite CO2 source; a controller in communication with the fill manifold and the at least one pressure transducer to automatically perform the leak checking of the fill manifold and the pressurization of the fill manifold, the controller having as a first input a first set point equal to the unallowable reduction in pressure of the vaporized CO2 in the fill manifold during a predetermined time period that the leak checking occurs, and further wherein the controller has a second set point equal to the predetermined lower pressure of the vaporized CO2 in the fill manifold below which dry ice may form and a third set point equal to the predetermined upper pressure of the vaporized CO2 above which reversible flow of CO2 vapor may occur from the container into the fill manifold; wherein the controller is configured to receive signals corresponding to real-time pressure measurements from the pressure transducer during the predetermined time period of the leak check and/or the pressurization of the fill manifold; said controller configured to prevent the subsequent filling operation when (i) one or more of the real-time pressure measurements has changed in pressure by an amount that is equal to or higher than the first set point of the unallowable reduction in pressure of the vaporized CO2 in the fill manifold, or (ii) the one or more of the real-time pressure measurements is lower than the predetermined lower pressure at which dry ice forms, or (iii) the one or more of the real-time pressure measurements is greater than the predetermined upper pressure at which reversible flow of CO2 vapor may occur from the container into the fill manifold; and said controller is configured to allow the subsequent filling operation when each of (i) the one or more of the real-time pressure measurements has change in pressure by an amount that is less than the first set point of the unallowable reduction in pressure of the vaporized CO2 in the manifold, and (ii) the one or more of the real-time pressure measurements is equal to or above the predetermined lower pressure at which dry ice forms, and (iii) the one or more real-time pressure measurements is equal to or lower than the predetermined upper pressure at which reversible flow of CO2 vapor may occur from the container into the fill manifold.

In a second aspect, a method of performing pre-fill integrity checks for automatically leak checking a fill manifold and pressurizing the fill manifold, comprising: introducing a finite amount of vaporized CO2 into a fill manifold operably connected to a source vessel of an onsite CO2 source, said fill manifold comprising a CO2 vapor supply conduit, said CO2 vapor supply conduit having a first end and a second end, the first end extending into a headspace of the source vessel of the onsite CO2 source, the second end extending towards a container; inputting a first set point into a controller in communication with the fill manifold, said first set point equal to the unallowable reduction in pressure of the vaporized CO2 introduced into the fill manifold; inputting a second set point into the controller, said second set point equal to a predetermined lower pressure of the vaporized CO2 in the fill manifold, said predetermined lower pressure being a pressure at which an onset of dry ice formation in the fill manifold can occur; inputting a third set point into the controller, said third set point equal to a predetermined upper pressure of the vaporized CO2 in the fill manifold above which reversible flow of CO2 vapor may occur from the container into the fill manifold; measuring the real-time pressures in the fill manifold and generating signals corresponding to each of the real-time pressures; transmitting the signals to the controller operably connected to the fill manifold; determining the pre-fill integrity checks, such that either (a) one or more of the real-time pressures (i) has changed in pressure by an amount that is equal to or higher than the first set point, or (ii) is equal to or lower than the second set point, or (iii) is greater than the third set point; and in response thereto preventing a subsequent filling of CO2 liquid from the onsite CO2 source to the container along the fill manifold; or (b) one or more of the real-time pressure measurements (i) has changed in pressure by an amount that is less than the first set point, and (ii) is above the second set point, and (iii) is lower than the third set point; and in response thereto allowing the subsequent filling of the CO2 liquid from the onsite CO2 source to the container along the fill manifold.

DETAILED DESCRIPTION OF THE INVENTION

Figure 1A:
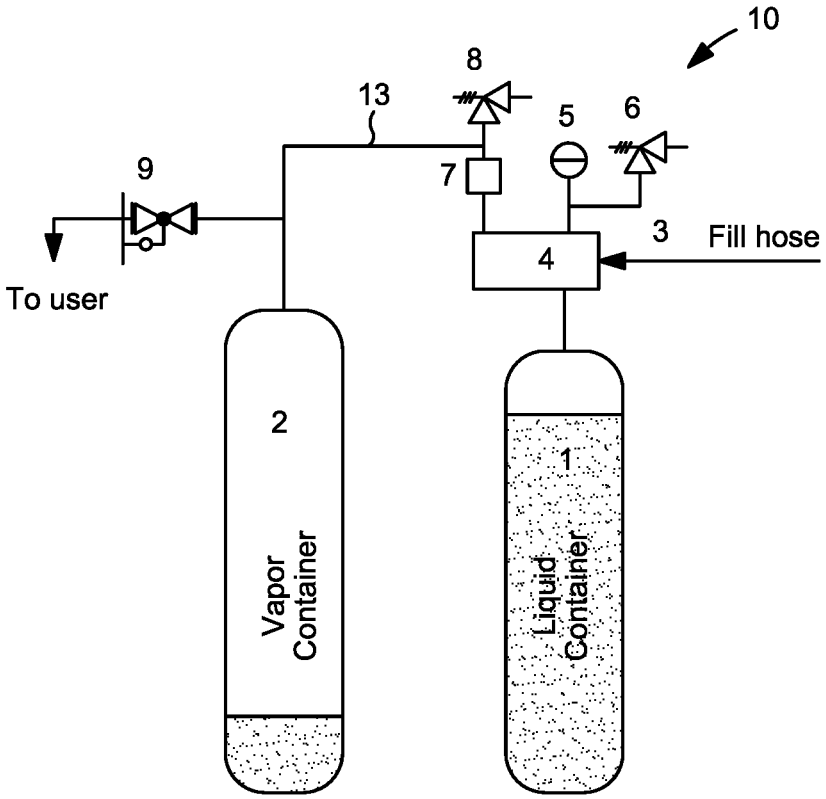
FIG. 1*a* is a process schematic that employs a two cylinder system for dispensing CO2 vapor to an end-user or customer in accordance with principles of the present invention.

As will be described with reference to the Figures the present invention offers a system for the on-site filling of a carbon dioxide (CO2) container system.

The present invention has recognized that expansion of liquid CO2 and its volume can increase by approximately 30 vol % when the temperature of the liquid cylinder increases from about 0 deg C. to 20 deg C. Therefore, an appreciable volume of CO2 can be transferred to the vapor container from the liquid container even though only the liquid cylinder is filled. Thus, the vapor cylinder contains not only vapor but also liquid. Furthermore, during use, more CO2 vaporizes from the liquid cylinder and is consumed by the customer compared to that from the vapor cylinder. Therefore, with subsequent or successive refills, the required volume of the vapor headspace may prove inadequate.

The present invention offers a novel solution for mitigating the risk of insufficient vapor headspace resulting in over-pressurization of the system by preferably consuming the $CO_2$ in the vapor container 2 rather than the CO2 in liquid container 1. The system 10 comprises a liquid $CO_2$ container 1 and a vapor $CO_2$ container 2 operably connected to the liquid CO2 container 1. As part of the methodology of the present invention, the vapor $CO_2$ container is designed to function as a so-called "virtual headspace" for the liquid $CO_2$ container 1 in a specific manner that avoids over pressurization of the system. $CO_2$ vapor product dispenses to an end-user or customer in a controlled manner, whereby the amount of $CO_2$ vapor product dispensed from the vapor CO2 container 2 is maximized, and the amount of $CO_2$ vapor product dispensed from the liquid CO2 container 1 is minimized. In this manner, a substantial portion of the overall $CO_2$ vapor product is obtained from the vapor CO2 container 2. Unlike other $CO_2$ storage and dispensing systems, the present invention limits transfer of $CO_2$ liquid from the liquid CO2 container 1 to the vapor CO2 container 2 until the pressure in the vapor CO2 container 2 has reduced to a certain level, at which point, a pressure differential device is triggered to allow the flow of CO2 fluid from the liquid CO2 container 1 to the vapor CO2 container 2. As such, CO2 liquid is preferentially depleted from the vapor CO2 container 2 prior to transfer of CO2 fluid from the liquid CO2 container 1.

Because of these distinctive operating features, the present invention offers numerous benefits, including, but not limited to, a system that can deliver the proper amount of liquid CO2 while also reducing the hazards associated with overfilling; a system which enables the end-user or customer to continue using the delivery system without interruption even when the system is being filled; a system that does not require an end-user or customer to enter the premises of the on-site dispensing system to shut down or adjust valving before and after delivery of the CO2 liquid; a system that allows automatic re-fill of CO2 fluid into the system at any time of the day or night without any contact with personnel; and a system that can reduce the amount of carbon dioxide vented to the atmosphere due to increase of temperature or as a means of determining a filled system, thereby resulting in less CO2 product waste, less cost to both the customer or end-user and less potential hazards.

It should be understood that the on-site systems of the present invention can include a single liquid CO2 container or multiple liquid CO2 containers directly or indirectly connected to a single vapor CO2 container or multiple vapor CO2 containers. The liquid CO2 container can receive and stores high-pressure liquefied CO2 from a refrigerated CO2 source. In one example, the liquid CO2 container can be refilled with the high-pressure liquefied CO2 from the CO2 source (e.g., automated truck having refrigerated and pressurized CO2 source) by a fill hose. "Fluid" as used herein means any phase including, a liquid phase, gaseous phase, vapor phase, supercritical phase, or any combination thereof.

"Container" as used herein means any storage, filling and delivery vessel capable of being subject to pressure, including but not limited to, cylinders, dewars, bottles, tanks, barrels, bulk and microbulk.

"Connected" as used herein means a direct or indirect connection between two or more components by way of conventional piping and assembly, including, but not limited to valves, pipe, conduit and hoses, unless specified otherwise.

The terms "liquid container" and "liquid CO2 container" will be used interchangeably to mean a container that contains substantially liquid. The terms "vapor container" and "vapor CO2 container" will be used interchangeably to mean a container contains substantially vapor.

The term "conduit", "flow leg" and "pathway" and "flow path" as used herein are intended to mean" mean flow paths or passageways that are created by any (i) conventional piping, hoses, passageways and the like; (ii) as well as within the valving, such as a shuttle valve.

"CO2 product" and "CO2 vapor product" will be used interchangeably and are intended to have the same meaning.

The present invention in one aspect, and with reference to FIG. 1*a*, has recognized the deficiencies of today's CO2 multiple container dispensing systems and discovered that the vapor CO2 container in such systems may contain CO2 fluid, such as liquid CO2, which may have been transferred and/or condensed in an uncontrolled manner from the liquid CO2 container. The transfer may be occurring during and/or after the filling, storage and/or use of the dispensing system. The transfer of the CO2 fluid into the vapor CO2 container may be occurring as a result of expansion of the liquid CO2 (i.e., an increase in specific volume) within the liquid CO2 container 1 when the container increases in temperature after being filled (e.g., walls of the liquid CO2 container 1 absorbing ambient heat from the atmosphere). The expansion of the liquid CO2 in the liquid container 1 may cause CO2 liquid in the liquid container 1 to transfer over into the vapor container 2. Alternatively or in addition thereto, the expansion of the liquid CO2 or CO2 fluid in the liquid container may compress the overlying CO2 vapor in the vapor headspace of the liquid container 1, thereby causing it to transfer into the vapor container 2 and form more liquid in vapor container 2.

The inventors have observed that this transfer of CO2 fluid from the liquid CO2 container 1 to the vapor CO2 container 2 has a tendency to accumulate CO2 liquid in the vapor CO2 container 2 if the CO2 liquid is not preferentially consumed in the vapor cylinder during usage. "Preferentially consumed during usage" as used herein means that CO2 vapor product is substantially delivered from the vapor CO2 container 2 to the end-user or customer while CO2 vapor product is limited from the liquid CO2 container 1 until substantially all of the liquid CO2 in the vapor container has vaporized and been dispensed to the end-user or customer. In particular, with regards to conventional systems, after one or more subsequent or successive fills of CO2 liquid into the liquid CO2 container 1 of the system 10, the liquid CO2 can accumulate within the vapor CO2 container 2, particularly when the customer or end-user does not use a significant amount of CO2 between the fills, thereby causing the total amount of CO2 in the system to exceed the maximum permitted filling capability (i.e., 68 wt % based on water weight capacity). In this manner, with regards to conventional systems, the virtual headspace of the vapor CO2 container 2 is reduced, and creates an on-site dispensing system that is potentially over pressurized. An overfilled liquefied CO2 system may experience significant internal pressure excursions and build-up from expansion of the liquid CO2 as it warms. As a result, the present invention has recognized that conventional CO2 storage, filling and dispensing systems are prone to over pressurization.

In accordance with the principles of the present invention, an exemplary system and method for optimizing the filling, storage and dispensing of CO2 from a liquid CO2 container and a vapor CO2 container is provided as will be described in connection with FIG. 1*a*. It should be understood that FIG. 1*a* is not drawn to scale, and some features are intentionally omitted for purposes of clarity to better illustrate the principles of the present invention. FIG. 1*a* depicts the CO2 storage and dispensing system 10. The system 10 can be assembled and installed at a customer site. The dispensing system 10 includes a liquid CO2 cylinder 1 and a vapor CO2 cylinder 2. However, it should be understood that any type of container as defined hereinbefore is contemplated by the present invention. Further, although a single liquid CO2 cylinder 1 and a single vapor CO2 cylinder 2 are shown, it should be understood that multiple liquid cylinders and vapor cylinders may be used depending on the end-use or customer consumption rates for a particular application.

During the filling and subsequent usage of the system 10, the liquid CO2 cylinder 1 stores a majority of the liquid CO2 while the vapor CO2 cylinder 2 contains mostly vapor CO2 and a minimal amount of liquid CO2, which evaporates and is then preferentially dispensed as vapor product to the customer or end user prior to the transfer of additional CO2 fluid from the liquid CO2 cylinder 1 to the vapor CO2 cylinder 2.

Various sizes of cylinders may be used for the liquid and vapor CO2 cylinders 1 and 2, respectively. Preferably, the vapor cylinder 2 is configured to be the same size or larger in volume than the liquid cylinder 1. As such, in comparison to conventional CO2 storage and dispensing systems, the present invention allows the vapor CO2 cylinder 2 to provide a larger virtual vapor headspace and capacity for liquid expansion therein. This virtual vapor headspace is preserved during filling, storage and use, thereby making the system safer than conventional CO2 storage and dispensing systems.

Suitable materials for the cylinders 1 and 2 may be selected based on operating temperature. Specifically, under certain conditions from the standpoint of materials of construction, the temperature of the liquid CO2 cylinder 1 and vapor CO2 cylinder 2 may be below safe limits for common carbon or alloy steel cylinder. Generally speaking, steel's ductile to brittle transition temperature is the result of its (i) alloy composition and (ii) heat treatment. Uncertainties in either property (i) or (ii) during fabrication of the steel cylinder may raise the materials' minimum ductile material temperature (MDMT) to unacceptable levels during filling of the liquid CO2 cylinder 1 with refrigerated CO2. Consequently, in one embodiment of the present invention, alloy steel containers or 6061 T6 aluminum cylinders may be preferred.

In a preferred embodiment, the liquid CO2 cylinder 1 may be filled by a refrigerated liquid CO2 source, such as a CO2 delivery truck that is equipped with a high pressure liquid CO2 pump. The filling is preferably based on pressure, such that when a pre-set fill pressure is reached, the high pressure liquid CO2 pump will stop. Referring to FIG. 1*a*, the refrigerated liquid CO2 can be pumped from a delivery truck through fill hose 3 and valve 4 into liquid cylinder 1. The temperature of the refrigerated liquid CO2 in the delivery truck is generally near 0 deg F.

Figure 1B:
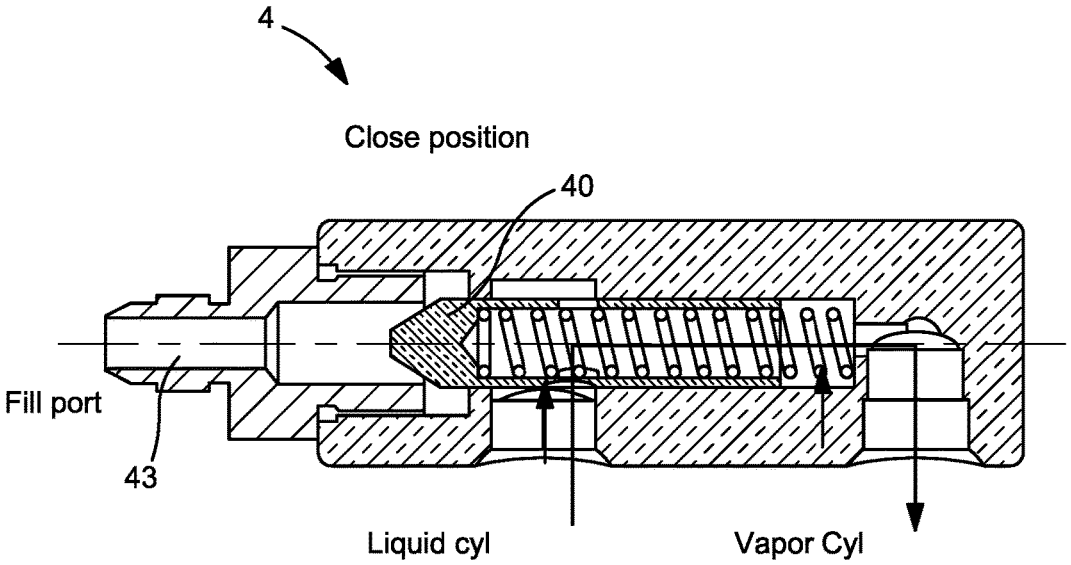
FIG. 1*b* shows a representative shuttle valve specifically employed during the dispensing operation in accordance with the principles of the present invention, whereby the fill port of liquid CO2 container is obstructed by the shuttle valve.
Figure 1C:
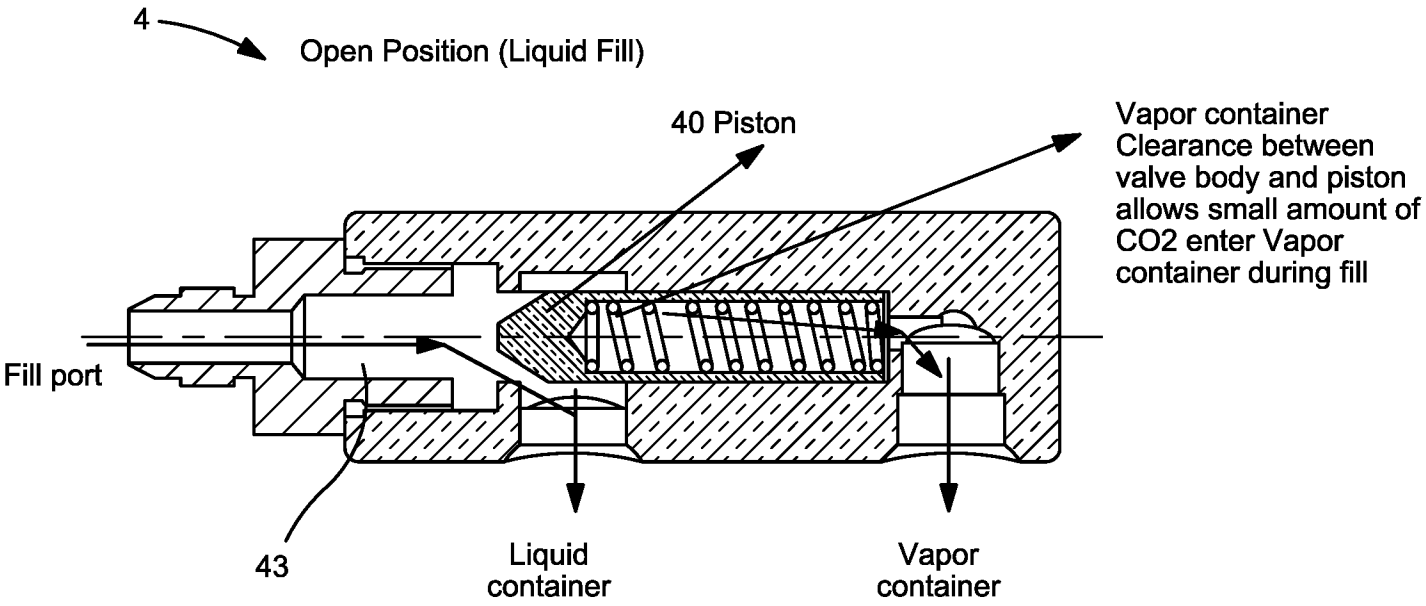
FIG. 1*c* shows the shuttle valve of FIG. 1*b* pushed into a biased state during filling into a CO2 liquid container in accordance with the principles of the present invention whereby the fill port of liquid CO2 container is unobstructed by the shuttle valve.

Valve 4 is a specially designed shuttle valve. The valve 4 includes a reciprocating shuttle valve 4, which is preferably spring-based. FIGS. 1*b* and 1*c* show a representative example of the operation of such a shuttle valve 4. Other structural elements of the system 10 have been omitted from FIGS. 1*b* and 1*c* for purposes of clarity. During normal operating mode (i.e., FIG. 1*b* where the liquid CO2 cylinder 1 is not being filled with pressurized CO2 from a CO2 source), the piston 40 is unbiased so that the flow path from fill hose 3 to the fill port 43 of liquid container 1 is normally closed by piston 40 and restricted flow path from liquid CO2 cylinder 1 to vapor CO2 cylinder 2 is normally open which allows restricted flow from the liquid cylinder 1 into the vapor cylinder 2. The restricted flow path can be created by virtue of a passageway extending within the piston 40 and into the vapor cylinder 2. A greater amount of CO2 fluid flow towards the vapor container 2 can occur when the shuttle valve 4 is unbiased as shown in FIG. 1*b* (given that the pressure differential device 7, which is situated between the containers 1 and 2, is in the open position) compared to when the shuttle valve 4 is biased and significantly such that there is no continuous flow path from the liquid container 1 to the vapor container 2 as shown in FIG. 1*c*, but for a narrow passageway to the vapor port by way of a clearance or gap between the valve body and the piston 40.

The filling operation in one aspect of the present invention will be explained. Referring to FIG. 1*a*, fill hose 3 is connected between the CO2 delivery source and the shuttle valve 4. The CO2 delivery source (i.e., "CO2 source") is preferably a refrigerated CO2 delivery truck. After completion of pre-fill and leak integrity checks as will be more fully described, the refrigerated CO2 liquid exits the CO2 source, and then can be pressurized by a pump, such as a high pressure liquid CO2 pump as may be commercially available. The liquid CO2 pump, which may be part of the delivery truck, pressurizes the liquid CO2 that exits from the CO2 source. The filling is preferably based on pressure, such that when a pre-set fill pressure is reached, the liquid CO2 pump will stop. For low pressure applications, the pre-set fill pressure may be about 300-400 psig. For filling an uninsulated container which requires relatively high pressure, the pre-set fill pressure needs to be greater than the vapor pressure of the CO2 in the uninsulated container, e.g. greater than 850 psig, preferably greater than 950 psig and more preferably greater than 1100 psig. The pressurized and refrigerated liquid CO2 flows through fill hose 3 and into the shuttle valve 4. The pressurized and refrigerated liquid CO2 exerts a force that pushes the piston 40 of shuttle valve 4 forward from the unbiased position of FIG. 1*b* to the biased position of FIG. 1*c*. The movement of the piston 40 unobstructs the fill port 43 and creates a flow path for liquid CO2 to enter liquid CO2 cylinder 1. The positioning of the piston 40 as shown in FIG. 1*c* substantially blocks the flow path from liquid cylinder 1, through the internal passageway of the piston 40 and into the vapor cylinder 2. The opening into the internal passageway of piston 40, through which CO2 from the liquid container 1 can enter into the piston 40, is blocked by the valve body of piston 40, as shown in FIG. 1*c*. In other words, the flow path of FIG. 1*b* along the internal passageway of piston 40, designated by arrows from liquid cylinder 1 to vapor cylinder 2, does not exist when the piston 40 is configured in its biased state as shown in FIG. 1*c*. Thus, a significant volume of the liquid cylinder 1 can be preferentially filled with the incoming pressurized and refrigerated liquid CO2. However, a specially designed gap or clearance between the housing of the valve body 4 and piston 40 as indicated by the arrow in FIG. 1*c* allows restricted flow from fill port 43 into the vapor cylinder 2 during the fill (as shown by arrows in FIG. 1*c*). In one embodiment of the present invention, a clearance between the valve body 4 and piston 40 is no more than about 0.003 inches to create less than about 25 wt % of the total CO2 fluid that is charged into the system 10 to enter into the vapor container 2 with the balance (i.e., 75 wt % of the total CO2 fluid charged) occupying the liquid container 1. Preferably, the CO2 enters the vapor container 2 at a fill rate range of about 20-30 lb/min. Accordingly, a controlled amount of restricted flow of CO2 fluid enters into the vapor cylinder 2 during liquid filling (FIG. 1*c*).

A pressure differential device 7, which can be located on the vapor port of the shuttle valve 4 and which is situated between the liquid cylinder 1 and the vapor cylinder 2 (FIG. 1*d*) is tuned to remain open during the filling operation as the pressurized CO2 refrigerated fluid exerts sufficient force against the valve element (e.g., ball valve) of the pressure differential device 7. In one example, the pressure differential device 7 is open as a result of being set at about 25 psig, while the vapor pressure of CO2 is 800 psig, and the pumping pressure of CO2 liquid is about 1100 psig. It should be understood that the pressure differential device 7 provides specific desired functionality during CO2 delivery to the end-user or customer, but not during the fill operation. In other words, the pressure differential device 7 is selectively utilized during use of the system 10 for CO2 vapor dispensing, as will be explained in greater detail below.

Contrary to conventional on-site CO2 filling processes which generally tend to fully isolate the vapor cylinder 2 from liquid cylinder 1 during filling of CO2 into the system 10, the present invention deliberately avoids complete isolation of the vapor cylinder 2 from the liquid cylinder 1 during the filling operation. The ability to allow a restricted amount of CO2 liquid into the vapor cylinder 2 through a restrictive pathway created and maintained during filling appears counterintuitive to the design objective of creating and preserving the vapor headspace of the vapor container 2. However, the relatively small amount of CO2 introduced into the CO2 vapor cylinder 2 can exert a certain pressure that allows for pressure equalization between both sides of the shuttle valve 4 and ultimately can substantially balance the pressure between liquid cylinder 1 and vapor cylinder 2, thereby allowing the return of the piston 40 towards the fill port 43 when the filling of the pressurized and refrigerated CO2 into the liquid CO2 cylinder 1 is completed, and the liquid CO2 pump has shut off. The ability for the piston 40 to reseat occurs without introducing a significant amount of CO2 liquid into the vapor container 2 that reduces the vapor headspace of the vapor cylinder 2. Accordingly, the filling operation allows substantial CO2 loading into the liquid cylinder 1 while minimizing liquid CO2 into the vapor cylinder 2 to preserve the vapor headspace of the vapor container 2. Without a restrictive passageway from fill port 43 along the clearance or gap between the body of valve 4 and the piston 40, the piston 40 may not reliably reseat onto the fill port 43. The undesirable result is substantial isolation of the vapor cylinder 2 from the liquid cylinder 1 during CO2 dispensing from the system 10 (i.e., the scenario of FIG. 1*c* where a restricted amount of flow of CO2 fluid occurs which is less flow than that permitted in the unbiased or reseated piston 40 configuration of FIG. 1*b* with pressure differential device 7 in the open state). Substantial isolation of the cylinders 1 and 2 during CO2 dispensing can lead to over pressurization when a sufficient amount of the CO2 fluid in the liquid cylinder 1 cannot transfer into the vapor cylinder 2 under certain operating conditions.

Additionally, when the vapor container 2 does not have significant positive pressure, such as may occur during start up, or during operation when the vapor cylinder 2 has low pressure, the piston 40 may not reseat due to higher pressure on the liquid fill port side of the shuttle valve 4 compared to that of the vapor fill port side. The liquid cylinder 1 is essentially isolated from the vapor cylinder 2 which potentially creates a hazardous overpressurized condition of the system 10, whereby the pressure in the liquid cylinder 1 can increase. Accordingly, the inclusion of a gap or clearance between the piston 40 of valve 4 and housing of the valve 4 that is in communication with the fill port 43 creates and maintains a restrictive flow path from fill port 43 into the vapor cylinder 2 during the filling operation (as shown by the arrows in FIG. 1*c*) that eliminates or significantly reduces the likelihood of over pressurization of the system 10.

As a result, complete isolation of the vapor cylinder 2 from the liquid cylinder 1 during fill is avoided by the present invention, but, in doing so, only a restrictive flow path is created and maintained during filling to allow a limited and controlled amount of CO2 fluid into the vapor cylinder 2 as necessary to reseat the piston 40 and substantially equalize pressures of the cylinders 1 and 2. In one embodiment, the amount of CO2 liquid entering the vapor cylinder 2 is less than 30 wt % of the total incoming flow of pressurized and refrigerated CO2 fluid from the CO2 source during a fill; preferably less than 20 wt %; and more preferably less than 10 wt %.

After filling, the pressure of the liquid cylinder 1 can continue increasing for many hours as the liquid CO2 will tend to evaporate until equilibrium is achieved. During this equilibrating period, the pressure differential device 7, situated between the liquid cylinder 1 and the vapor cylinder 2, can remain open, in response to a predetermined pressure difference between the cylinders 1 and 2, which prevents the liquid cylinder 1 from overpressurizing.

Upon completion of filling, and after the system 10 has stabilized to reach a substantial equilibrium state, the use of the system 10 for dispensing CO2 vapor product to an end-user or customer can occur, as will now be described. It should be noted that initially, during use of the system 10 to dispense CO2 vapor product, the piston 40 of the shuttle valve 4 reseats into its unbiased position and remains in the unbiased position (FIG. 1*b*), and a pressure differential device 7 is initially closed as a result of pressure equalization between the liquid cylinder 1 and vapor cylinder 2. As such, isolation occurs between the liquid cylinder 1 and the vapor cylinder 2, and the restrictive flow pathway created and maintained during filling is eliminated during the dispensing of vapor product from the vapor cylinder 2. It is preferable to maintain a positive pressure difference ranging from 10 to 1000 psig in the liquid cylinder 1 relative to the vapor cylinder 2; preferably 10-500 psig; and more preferably 10-250 psig. The positive pressure ensures that CO2 liquid is consumed from the vapor cylinder 2 before additional CO2 fluid is transferred by the liquid cylinder 1 into the vapor cylinder 2.

Although the piston 40 is not substantially blocking the flow path to the vapor cylinder 2 to create a restrictive flow pathway, as can occur during filling, as will be explained herein below, a pressure differential device 7 is situated between the liquid cylinder 1 and the vapor cylinder 2. The pressure differential device 7 is specifically triggered to open and close under specific operating conditions to preferentially deplete CO2 liquid from the vapor container 2. Specifically, CO2 vapor product is preferentially dispensed from the vapor CO2 container 2 with the pressure differential device 7 in the closed position, until a pressure difference between the liquid CO2 container and the vapor CO2 container acquires a set point value, at which point pressure differential device 7 opens to allow additional CO2 fluid to be transferred from the liquid container 1 to the vapor container 2. Preferably, the pressure differential device 7 is set to a certain pressure difference between the liquid container 1 and the vapor container 2 that must be reached or exceeded before opening to allow CO2 fluid transfer from the liquid container 1 to the vapor container 2. Alternatively, the pressure differential device 7 can be set to a certain set point that the pressure in vapor container 2 must reach or drop below before opening. The pressure differential device 7 in the open position allows subsequent or successive refill of CO2 liquid into the liquid CO2 container and/or a transfer of CO2 fluid from the liquid CO2 container 1 to the vapor CO2 container 2.

Figure 1D:
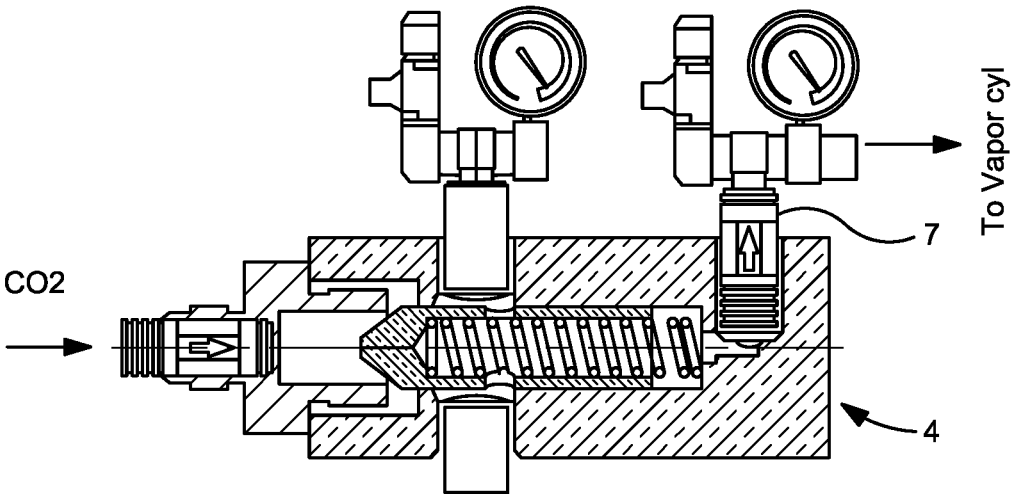
FIG. 1*d* show an exemplary pressure differential device integrated with a shuttle valve in accordance with the principles of the present invention.

The pressure differential device 7 can be installed on the vapor port of shuttle valve 4 as shown in FIG. 1*d*. Alternatively, the pressure differential device 7 can be situated downstream of shuttle valve 4 along the conduit 13 extending between the liquid cylinder 1 and the vapor cylinder 2. FIG. 1*a* is intended to represent the pressure differential device 7 integrated into the vapor port of shuttle valve 4 or the pressure differential device 7 situated downstream of the shuttle valve 4. Any in-line pressure differential device 7 is contemplated, including a critical orifice, capillary, pressure relief valve, active in-line spring-loaded backpressure device and any other suitable device capable of being set to activate into an open position at a predetermined pressure difference between the liquid container 1 and the vapor container 2 so as to maintain limited transfer of CO2 fluid from the liquid container 1 to the vapor container 2 upon preferential depletion of the CO2 liquid from the vapor container 2.

Referring to FIG. 1*a*, during supply to the end-user or customer through a pressure regulator 9, the transfer of vapor CO2 from the liquid cylinder 1 to the vapor cylinder 2 is limited by the pressure differential device 7, until a certain pressure difference between the liquid container 1 and the vapor container 2 is reached. For example, when pressure in the vapor cylinder 2 drops to a certain level that increases the pressure difference between the liquid and vapor cylinders 1 and 2, the pressure differential device 7 (i.e., also referred to as the set point pressure of the pressure differential device 7 or the pressure drop of the pressure differential device 7) is triggered into the open position. The set point pressure or pressure drop of the pressure differential device 7 at which it opens will be set to a level for ensuring that a lower pressure may persist in the vapor cylinder 2 that is designed to primarily supply the CO2 vapor product to the end-user or customer without substantial transfer or supply of vapor CO2 from the liquid container 1, thereby resulting in preferential vaporization and subsequent consumption of the liquid CO2 contained within the vapor cylinder 2. In one example, the set point is 5-100 psi, preferably 10-75 psi and more preferably 10-50 psi. Setting the pressure differential device 7 to activate into the open position when the pressure in the vapor container 2 has reduced to a certain level will preferentially consume liquid CO2 from the vapor cylinder 2 prior to CO2 fluid being transferred from liquid cylinder 1 to the vapor cylinder 2 and/or CO2 vapor withdrawn from the liquid cylinder 1 to the end-user or customer. In one embodiment, so long as the vapor cylinder 2 is not liquid dry, the weight ratio of vapor product dispensed from the vapor cylinder 2 to the vapor product dispensed from the liquid cylinder 1 is approximately 1:1 or higher, preferably about 1.5:1 or higher and more preferably about 2:1 or higher.

Without being bound by any particular theory or mechanism, it is believed that the preferential depletion of CO2 liquid in the vapor cylinder 2 may occur as follows. As CO2 vapor is withdrawn from the vapor cylinder 2, the vapor pressure in the vapor cylinder 2 drops to a level that is lower than the initial vapor pressure corresponding to the initial temperature, which is typically ambient temperature (i.e., the temperature of the premises where the vapor cylinder 2 is located). The reduction in pressure causes liquid CO2 in the vapor cylinder to evaporate to re-establish the vapor pressure in the vapor cylinder 2.

The evaporation of the CO2 liquid requires a heat of evaporation, which can cool the vapor cylinder 2. The cooling of the vapor cylinder 2 causes the overall pressure to drop in the vapor cylinder 2. Accordingly, as CO2 liquid in the vapor cylinder 2 is preferentially vaporized and then dispensed with the pressure differential device 7 in the closed position, the pressure in the vapor container 2 decreases during operation of the system 10 until the pressure has reduced to a certain level that creates a pressure difference between the liquid container 1 and the vapor container 2 that is equal to or greater than the set point pressure of the pressure differential device 7 at which point the device 7 is triggered to open. Upon the pressure in the vapor container 2 dropping to below the certain level, the pressure differential device 7 is activated into the open position to allow transfer of CO2 fluid from the liquid container 1 to the vapor container 2. It should be noted that the shuttle valve 4 remains in the unbiased position (FIG. 1*b* and FIG. 1*d*) and therefore does not restrict transfer of CO2 fluid from the liquid cylinder 1 to the vapor cylinder 2. In other words, CO2 fluid can enter into the hollow passageway of piston 40 and flow therealong and enter into vapor container 2 (as indicated by the lines with arrows in FIG. 1*b*) because the openings into the hollow passageway of piston 40 are not blocked by the valve body.

CO2 fluid transfer into the vapor cylinder 2 occurs along conduit 13 until the pressure in the vapor cylinder 2 has increased to above a predetermined level so as to decrease the pressure difference between the liquid cylinder 1 and the vapor cylinder 2 below the set point pressure of the pressure differential device 7, at which point the pressure differential device 7 switches from open to the closed position. In this manner, the present invention establishes the set point pressure of the pressure differential device 7 to be an operating value that allows preferential depletion of CO2 liquid from the vapor cylinder 2, thereby reducing or eliminating the risk of over pressurization arising from accumulation of the CO2 liquid level in the vapor cylinder 2—a methodology not previously employed with currently utilized on-site CO2 dispensing systems.

The present invention has discovered that without use of the pressure differential device 7 in the manner described herein, during the supply of CO2 vapor product to the customer, CO2 in the liquid cylinder 1 vaporizes and flows into the CO2 vapor cylinder 2 and/or directly to the end-user, until a pressure equilibrium is established in both the liquid cylinder 1 and the vapor cylinder 2. Since the liquid cylinder 1 generally contains more liquid CO2 than the vapor cylinder 2, the evaporation rate of the CO2 liquid in the liquid cylinder 1 is typically faster than in the vapor cylinder 2. Consequently, more CO2 from the liquid cylinder 1 is observed to be dispensed to the customer or end user. As a result, the liquid CO2 in the vapor cylinder 2 may undergo a slower rate in depletion, which could cause accumulation in the vapor cylinder 2 during CO2 fluid transfer from the liquid cylinder 1 to the vapor container 2, as well as during subsequent filling operations. The net effect would be an increased risk of over pressurization in the vapor cylinder 2, as the vapor space of the vapor cylinder 2 is being reduced during operation.

As can be seen, in accordance with the principles of the present invention, the pressure differential device 7 limits $CO_2$ vapor flow from the liquid container 1 into the vapor container 2 during use when the vapor container 2 contains liquid $CO_2$. Specifically, when the vapor container 2 contains liquid $CO_2$ (i.e., the vapor cylinder 2 is not liquid dry), the pressure differential device 7 limits the transfer of vapor $CO_2$ flow from the liquid container 1 into the vapor container 2 until substantially all of the liquid phase $CO_2$ in the vapor container has been vaporized and subsequently consumed or depleted. In one example, the present invention vaporizes at least 75 wt % of $CO_2$ liquid in the vapor $CO_2$ container prior to introducing $CO_2$ liquid and/or $CO_2$ vapor (collectively "$CO_2$ fluid") from the liquid $CO_2$ container 1 to the vapor $CO_2$ container 2. The present invention utilizes the pressure differential device 7 to isolate the vapor container 2 from the liquid container 1 under such operating conditions to allow the liquid $CO_2$ in the vapor container 2 to be preferentially consumed before the $CO_2$ vapor from the liquid container 1. In this manner, liquid $CO_2$ is prevented from accumulating in the vapor container 2, which consequently minimizes the risk of $CO_2$ overfill and over pressurization of the on-site two container system.

Referring to FIG. 1*a*, an optional pressure gauge 5 may be installed on the liquid port and also vapor port of the shuttle valve 4 to monitor the pressure of liquid container 1. A pressure relief valve 6 may be used to protect the manifold and cylinders 1 and 2. An additional pressure relief valve may be installed on the vapor port of the shuttle valve 4.

The ability of the present invention to preferentially withdraw vapor product from the vapor cylinder 2 as opposed to the liquid cylinder 1 is demonstrated by the tests described in the following Examples.

Comparative Example 1 (Conventional System)

Figure 2A:
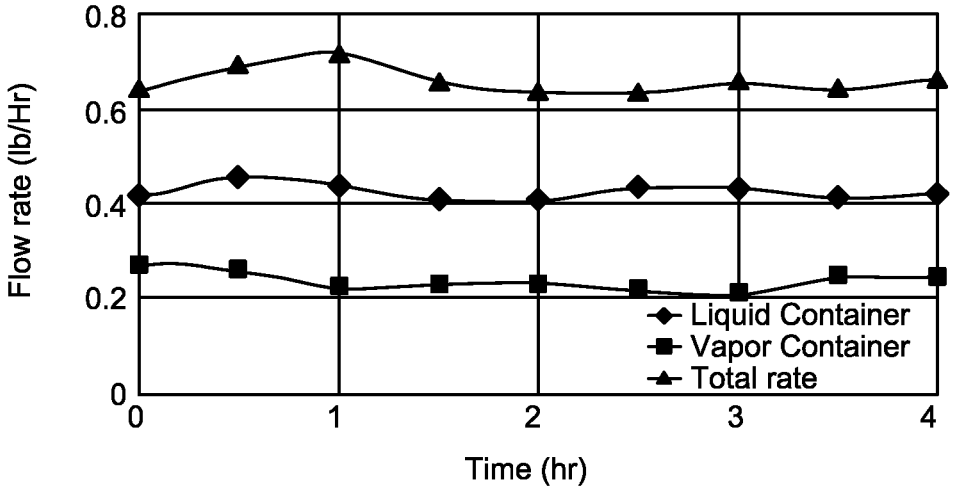
FIG. 2*a* shows weight loss rates of CO2 from a CO2 liquid container and a CO2 vapor container operated by conventional means.

The behavior of a conventional two cylinder $CO_2$ dispensing system was evaluated. The vapor cylinder was not isolated from the liquid cylinder during use. The weight loss of the liquid cylinder and the weight loss of the vapor cylinder were monitored. FIG. 2*a* shows weight loss rates of liquid cylinder and vapor cylinder that were observed during supply to customer at a total flow rate of approximately 0.65 lb/hr. The weight loss of the liquid container was almost 2 times higher than that of the vapor container. The weight ratio of vapor product dispensed from the vapor cylinder 2 to the vapor product dispensed from the liquid cylinder 1 was observed to be approximately 0.5. During the process, the pressure of the liquid container was the same as that of the vapor container.

Example 1 (Present Invention)

Figure 2B:
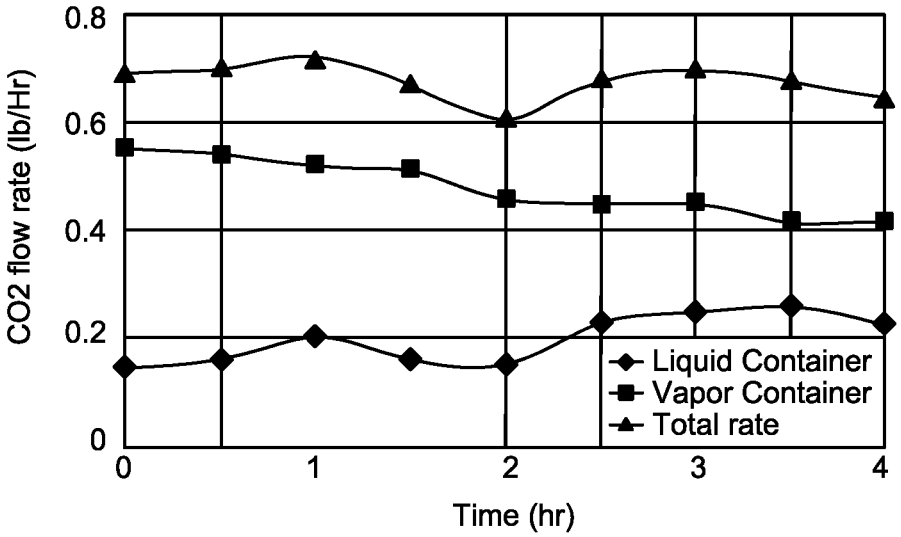
FIG. 2*b* shows weight loss rates of CO2 from a CO2 liquid container and a CO2 vapor container operated in accordance with principles of the present invention.

The behavior of an improved two cylinder $CO_2$ dispending system was evaluated. The system was configured as shown in FIG. 1*a*. The system was operated in accordance with the principles of the present invention. A restrictive flow pathway was created and maintained with the shuttle valve during filling of the liquid cylinder with refrigerated $CO_2$ liquid from a liquid $CO_2$ source. A limited amount of $CO_2$ fluid was permitted to transfer from the liquid cylinder to the vapor cylinder when the pressure of the vapor cylinder was reduced to below a set point value of the pressure differential device, which was a 25 psig check valve (i.e., the check valve was tuned to open at a pressure difference between the liquid and vapor cylinders of 25 psig). The weight loss of the liquid cylinder and the weight loss of the vapor cylinder were monitored. FIG. 2*b* shows the weight loss rates of liquid container and vapor container that were observed during supply to customer at a total flow rate of 0.7 lb/hr with a 25 psi pressure differential device. The weight loss of liquid container was much lower than that of vapor container. The weight ratio of vapor product dispensed from the vapor cylinder 2 to the vapor product dispensed from the liquid cylinder 1 was observed to be approximately 2.5. The results indicated that $CO_2$ vapor product was preferentially dispensed from the vapor cylinder.

Example 2 (Present Invention)

Figure 4:
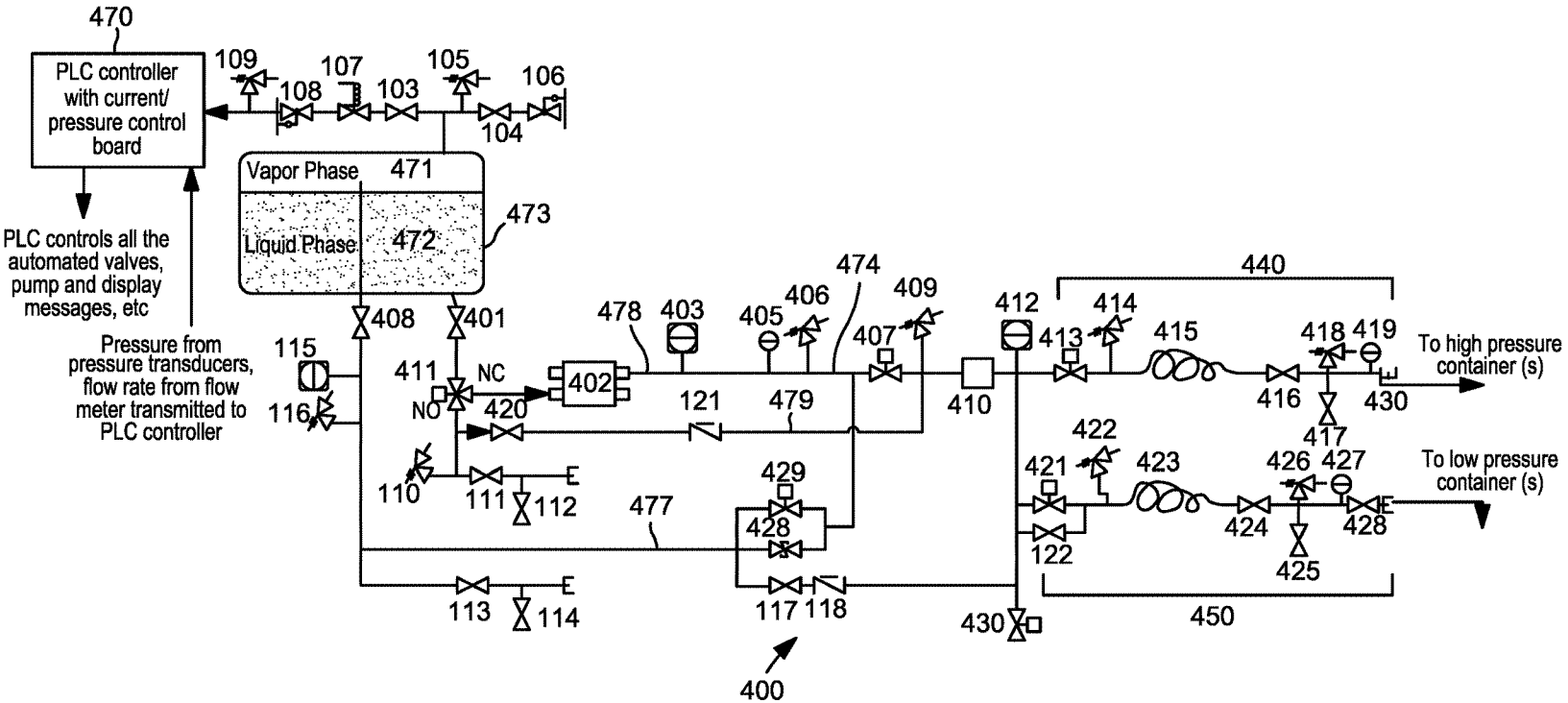
FIG. 4 shows a representative process schematic for a CO2 fill system in accordance with the principles of the present invention.

The system of FIG. 1*a* was tested to determine fill capacity behavior. The system was operated in accordance with the principles of the present invention. The system included a 37 L liquid container and a 42 L vapor container. A restrictive flow pathway was created and maintained with the shuttle valve during filling of the liquid container with refrigerated $CO_2$ liquid from a liquid $CO_2$ source. The liquid container was filled to a fill pressure of 1200 psig for all tests. All of the tests were performed at various levels of residual $CO_2$ liquid in the liquid container of the system, ranging from 5% to 65% of the container volume capacity. The results are shown in FIG. 4. All tests indicated that the total amount of $CO_2$ in the system was below 68 wt % total based on water weight regardless of the amount of residual $CO_2$ in the liquid container prior to filling.

The results indicate that the conventional dispensing system and method of Comparative Example 1 failed to preferentially consume $CO_2$ from the vapor container, creating an operating scenario conducive for accumulation of $CO_2$ liquid in the vapor container with subsequent or successive fills. The conclusion from the tests was that over pressurization was likely in the case of Comparative Example 1, but significantly reduced or eliminated with the system and method of Example 1; and that the inventive system was capable of not exceeding maximum permitted filling regulatory requirements as demonstrated in Example 2.

While it has been shown and described what is considered to be certain embodiments of the invention, it will, of course, be understood that various modifications and changes in form or detail can readily be made without departing from the spirit and scope of the invention. It is, therefore, intended that the present invention not be limited to the exact form and detail herein shown and described, nor to anything less than the whole of the invention herein disclosed and hereinafter claimed. For example, pressure gauges, pressure relief valves and pressure differential device may be integrated or built into the valve 4. Additionally, valve 4 may be connected to the valve of liquid container 1 through a flexible hose or it may be installed on liquid container 1 directly without using a cylinder valve.

Additionally, the pressure regulator 9 that dispenses $CO_2$ to an end-user or customer may be integrated or built into the shuttle valve 4. Alternatively, the pressure regulator 9 may be integrated to the vapor cylinder valve.

Other modifications and/or instrumentation are also contemplated by the present invention in addition to or independently to achieve similar control for minimizing liquid inventory within the vapor container. Specifically, the present invention can incorporate a means of measuring the liquid level in the vapor container and not permit fill when the liquid level is above a certain value. Level detection may be achieved using capacitance level gauges or optical level detection. By way of example, the monitoring of liquid level of $CO_2$ in the vapor cylinder 2 may be used as an additional safety feature during fill and the basis for controlling the amount of CO2 fluid charged into the system 10. Under normal operation, it is expected that the target fill pressure is achieved prior to the liquid level in the vapor cylinder 2 attaining a predetermined maximum liquid level. However, in the event that the system 10 is not operating under normal operating conditions during fill such that a predetermined maximum liquid level in the vapor cylinder 2 is attained that can create a hazardous condition of overpressurization, the system 10 can shut off upon reaching such predetermined maximum liquid level in the vapor cylinder 2 even though the target fill pressure has not been attained. Specifically, when the liquid level in the vapor container 2 reaches a pre-determined maximum level regardless of whether the target fill pressure has been attained, the filling operation will stop which further ensures the system 10 does not over fill. Alternatively the liquid level in the vapor container 2 may be used solely to control the fill, such that once the liquid level in the vapor cylinder 2 reaches the predetermined maximum liquid level, the fill can stop. Either control means ensures the filling operation does not continue based on attaining a predetermined maximum liquid level in the vapor cylinder 2.

In yet another example, if the fill flow rate is lower than the normal or expected fill rate, more liquid CO2 may be allowed over time (i.e., during the course of subsequent and/or successive refills) to transfer from the liquid container 1 into the vapor container 2 than may occur at the normal fill rate. The methodology of monitoring liquid level in the CO2 vapor container 2 may ensure that the filling is shut off upon detecting the predetermined maximum liquid level in the vapor cylinder 2. Still further, before filling occurs, there may be a scenario where the liquid level in the vapor cylinder 2 is at the predetermined maximum level such that filling would not be permitted to ensue. Such scenarios represent departure from normal operation conditions which can be remedied by monitoring and detecting CO2 liquid level in the vapor container 2.

Besides the level monitoring techniques described herein, the present invention also contemplates thermal imaging techniques and temperature sensitive strip techniques as the means to monitor liquid CO2 liquid levels in the vapor cylinder 2 during the filling operation when the CO2 liquid is relatively lower in temperature than that of the cylinders 1 and 2.

In one embodiment, a two-cylinder system of the present invention in which both cylinders are the same size is operated such that the maximum CO2 liquid level in the vapor cylinder 2 during fill may be controlled to be no more than 55%, preferably no more than 45% and more preferably no more than 35% based on total volume of CO2 in the system 10. The exact liquid level in the vapor cylinder 2 can vary based on the size of each of the two cylinders 1 and 2, respectively. If the vapor cylinder 2 is larger in volume capacity than the liquid cylinder 1, then the liquid level in vapor cylinder 2 can be relatively higher, provided that the total amount of CO2 in the system can't be over 68 wt % by water weight under any conditions.

Still further, load cells may be placed underneath the vapor container 2, and the fill of the liquid container 1 will be prevented unless the load cells indicate the weight of the vapor container 2 with little or no liquid phase present, e.g., tare weight plus 10 lbs. maximum for a 43 L container. The 43 L container can have 14 lb CO2 even if liquid dry. The amount of CO2 allowed in the vapor cylinder can depend, at least in part, on the size of the liquid and vapor containers. For example, if the 43 L container is used for both liquid and vapor containers, 1 and 2, respectively, the vapor container 2 preferably has a maximum of approximately 40 lb CO2.

In yet an alternative design, an independent port and dip tube may be added to vent the liquid CO2 present in the vapor container during fill. The depth of the dip tube is predetermined so as to control and limit the level of liquid CO2 in the vapor cylinder. The vent line may be routed back to the CO2 source (e.g., CO2 truck) instead of open to the atmosphere. Still further, the present invention may also be modified to warm the vapor container to preferentially vaporize its CO2 liquid inventory contained therein.

Figure 3:
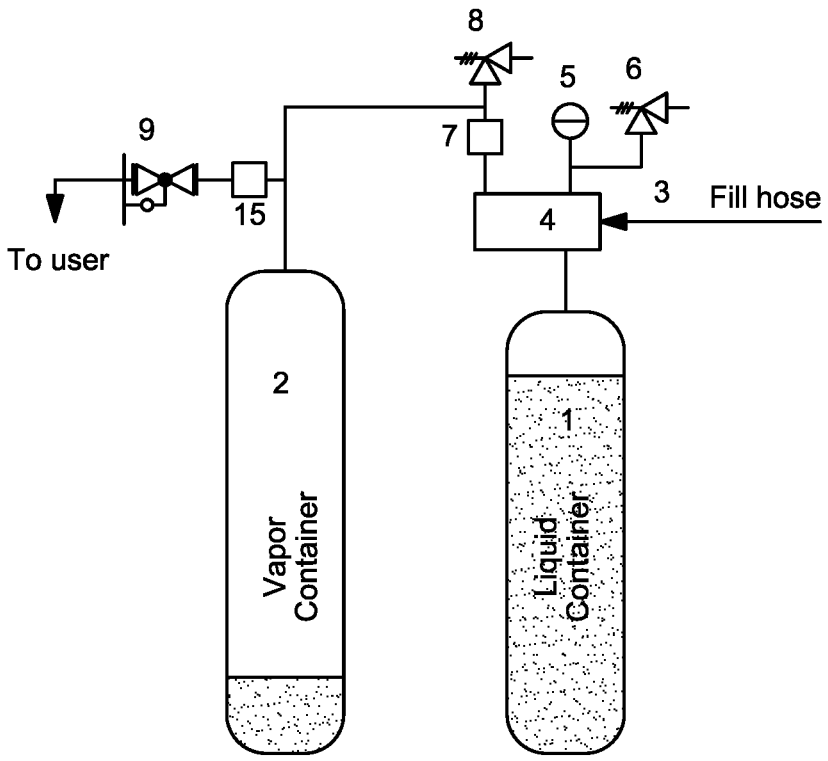
FIG. 3 is an alternative embodiment of the present invention including a residual pressure control device.

In another modification, a residual pressure control device 15, as shown in FIG. 3, may be used. The residual pressure control device 15 may be optionally integrated into the vapor cylinder valve or installed between the vapor cylinder 2 and pressure regulator 9, or between pressure differential device 7 and vapor cylinder 2. It can also be incorporated into vapor cylinder valve, supply regulator, shuttle valve, or combination. Preferably, the residual pressure control device 15 is used on the vapor supply. The residual pressure control device 15 retains a small positive pressure in the containers, e.g., 60 psig or above for the CO2 liquid and pressure containers 1 and 2, respectively. The use of the residual pressure control device 15 not only can prevent the possibility of back contamination, but can prevent dry ice formation during the fill which can occur if the pressure of the container is less than 60 psig. Accordingly, the residual pressure control device can reduce the risk of brittlement of containers 1 and 2.

It should be understood that the present invention has versatility to be employed in various applications. For example, the on-site system of the present invention can be utilized in beverage, medical, electronics, welding and other suitable applications that require on-site CO2 delivery. The present invention is also capable of filling and dispensing CO2 at any CO2 purity grade.

As has been described, the present invention contemplates several means of ensuring that sufficient headspace is provided by the vapor container. Rather than control the fill state of the liquid container as is typical with conventional systems, the present invention focuses on preserving the headspace of the vapor container by limiting CO2 fluid flow to the vapor container from the liquid container during customer usage and/or, by directly or indirectly evaluating the CO2 liquid inventory of the vapor container. As a result, the design of the present invention is aimed to reduce the likelihood of accumulating liquid $CO_2$ in the vapor container that can possibly result in insufficient vapor headspace which is unable to accommodate liquid expansion from the liquid container after filling of the liquid container with refrigerated and pressurized CO2 liquid. As such and in this manner, the present invention represents a significant departure from conventional systems which solely focused on the contents of the liquid container, but failed to provide a solution for handling an increase in specific volume (e.g., ~30%) as a result of the temperature increase of the liquid CO2, for example, from 0 deg C. to 20 deg C. or higher.

Figure 5:
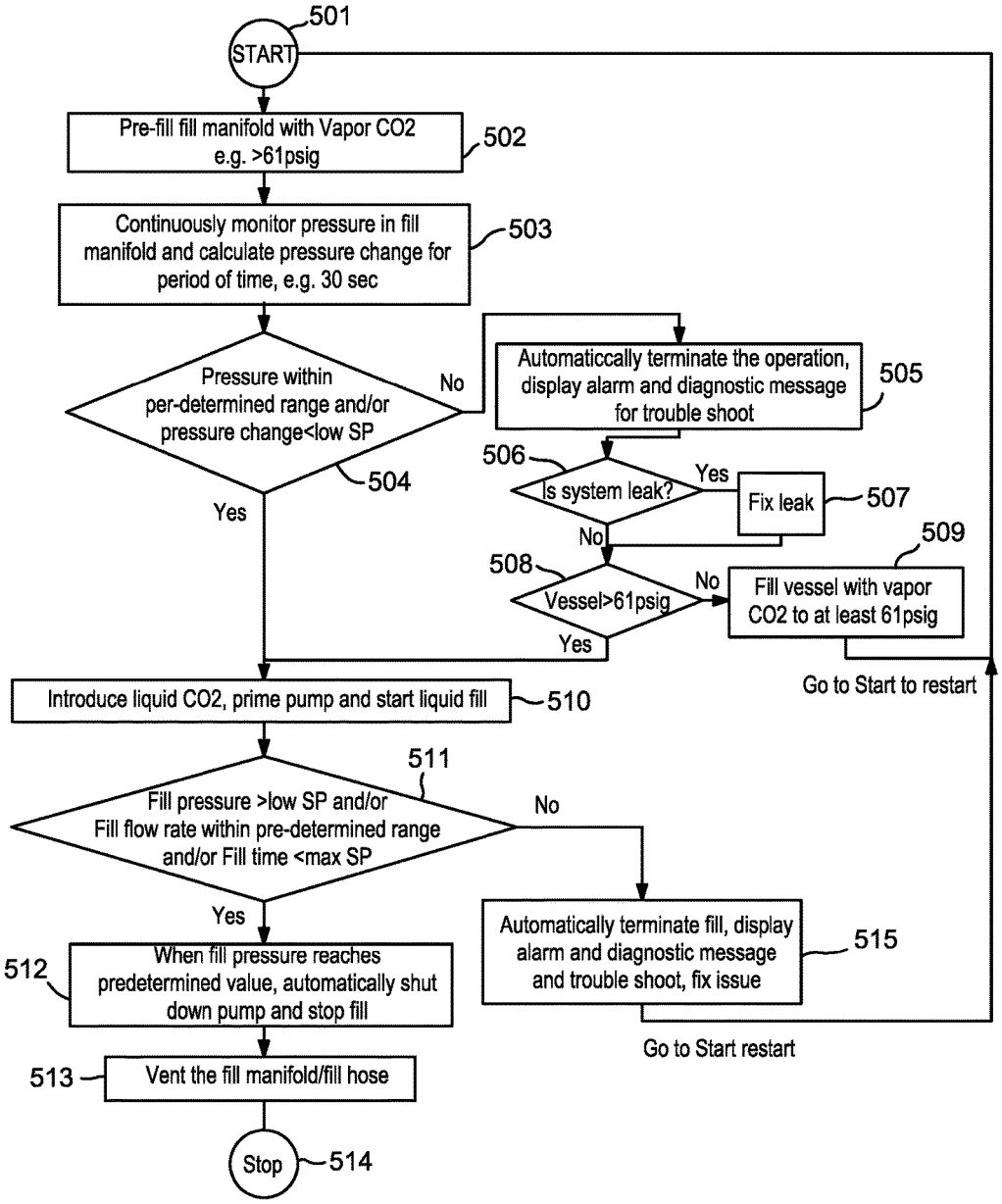
FIG. 5 shows representative control logic in accordance with the principles of the present invention that may be employed in the CO2 fill system of FIG. 4.
Figure 6:
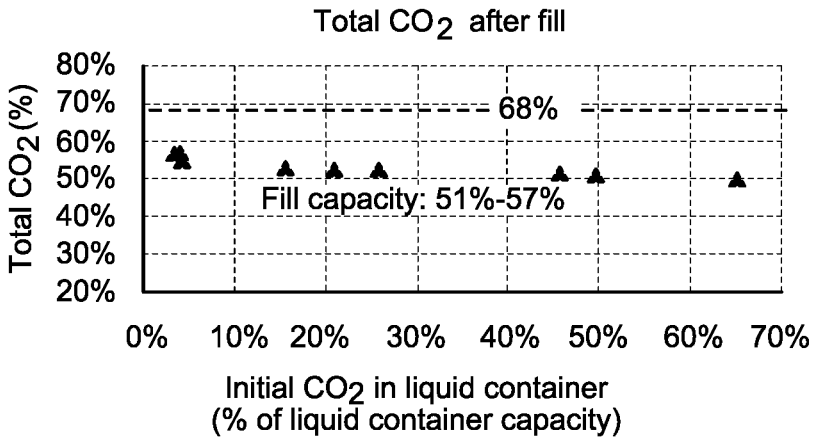
FIG. 6 shows fill capacity behavior into a CO2 liquid container and a CO2 vapor container operated in accordance with the principles of the present invention.

In yet another embodiment of the present invention, prior to filling the CO2 containers of FIG. 1*a*, a CO2 safety interlock fill system 400 can be employed to ensure that the filling operation is not leaking and is suitably pressurized within a certain pressure range. An exemplary safety interlock fill system 400 incorporating certain control methodology will now be described in connection with FIGS. 4 and 5. FIG. 4 is a process schematic that shows CO2 safety interlock fill system 400 which can be used to perform certain pre-fill integrity checks (as will be described) and, if such checks pass required criteria, subsequently fill the system 10 of FIG. 1*a* or any other CO2 container or containers (e.g., low pressure container such as a microbulk container). It should be understood that FIG. 4 is not drawn to scale, and some features are intentionally omitted for purposes of clarity to better illustrate the principles of the present invention in accordance with FIG. 4 and FIG. 5. FIG. 5 depicts the safety interlock control methodology 500 that can be employed by the safety interlock fill system 400 prior to filling and during filling.

The safety interlock fill system 400 is indicated by dotted line in FIG. 4 to include an onsite CO2 source that includes source vessel 473 along with various valving, instrumentation and conduits. The onsite CO2 source is generally located external to downstream CO2 containers, which are situated inside a building or other confined area. The onsite CO2 source is preferably self-powered such that no external electric power or other external utilities are needed to operate the pre-fill integrity checks of the CO2 safety interlock fill system. The system 400 is connected at a customer site to a customer's high pressure containers and/or low pressure containers, which may be located inside a building. In a preferred embodiment, system 400 is located on a transportable vehicle that is driven to a customer site where the CO2 containers are located. The source vessel 473 is defined, at least in part, by liquefied CO2 472 (i.e., liquid CO2) occupying a bottom of the source vessel 473 with CO2 vapor 471 in a headspace of the source vessel 473. The solenoid valve 107, pressure regulator 108 and pressure relief valve 109 are positioned above the source vessel 473 to receive a portion of CO2 vapor 471 for the supply to pneumatic control valves (i.e., process control valves of FIG. 4) via control valving manifold inside the PLC controller 470 of FIG. 4. It should be understood that any control valve can be used, including a solenoid valve. Preferably, the process control valves of FIG. 4 are pneumatic valves whereby CO2 vapor 471 is used as the pneumatic gas source to supply source gas to open and close all the process pneumatic control valves of FIG. 4. However, manual or solenoid valves can also be used.

A fill manifold 474 is connected to the source vessel 473. The fill manifold 474 preferably includes a network of conduits to allow leak checking and pressurization with CO2 vapor 471 and then subsequent CO2 liquid filling into downstream containers. The fill manifold 474 includes a vapor supply conduit 477 that is used to perform the pre-fill integrity checks (e.g., leak check and pressurization of the fill manifold 474) as will be explained below. FIG. 4 shows that one end of the vapor supply conduit 477 extends into the headspace of the source 473, and another end of the vapor supply conduit 477 is connected to a high pressure conduit 440 and a low pressure conduit 450, each of which extends towards their respective downstream containers. High pressure conduit 440 includes automated isolation valve 413, line block safety relief 414, flexible fill hose 415, optional manual fill valve 416, optional manual bleed valve 417, pressure relief device 418, pressure gauge 419 and quick connector 430. Low pressure conduit 450 includes automated isolation valve 421, an optional manual by pass isolation valve 122, line block safety relief 422, flexible fill hose 423, optional manual fill valve 424, optional manual bleed valve 425, pressure relief device 426, pressure gauge 427 and quick connector 428. The use of dedicated conduits with different types of quick connectors 428 and 430 avoids the operator inadvertently connecting a high pressure conduit 440 to a low pressure container for filling and vice versa.

A pump 402 is situated along a liquid supply CO2 conduit 478. The pump 402 is used to pressurize liquid CO2 472 withdrawn from bottom portion of source vessel 473. Such pressurization may be required when filling containers with CO2 liquid 472 withdrawn from source vessel 473 along the high pressure conduit 440 as well as when replenishing the low pressure containers located downstream of low pressure conduit 450. The safety interlock system 400 also includes a controller 470, preferably a programmable logic controller (PLC). To allow the PLC 470 to perform the integrity checks, the PLC 470 receives various inputs, including a first set point equal to the unallowable reduction in pressure of the CO2 vapor in the fill manifold 474 during a predetermined time period that the leak checking occurs; a second set point equal to the predetermined lower pressure of the CO2 vapor in the fill manifold 474 below which dry ice may form; and a third set point equal to the predetermined upper pressure of the CO2 vapor in the fill manifold 474 above which reversible flow of vapor CO2 from the high pressure containers into the fill manifold 474 may be occurring. Such reversible flow of the vapor CO2 is not desirable, as subsequent venting of the fill manifold 474/fill hose 415 can cause CO2 from the high pressure containers to be vented.

An example of a pre-fill integrity check utilizing the control methodology 500 in FIG. 5 will now be described prior to determining whether the filling of CO2 liquid into high pressure containers (e.g., containers which can handle up to 1200 psig or higher) can proceed. Preferably, the high pressure containers are a two cylinder system, as shown in FIG. 1*a*. FIG. 4 indicates the high pressure cylinders located downstream of the high pressure conduit 440. Having deployed and connected the safety interlock fill system 400 as shown in FIG. 4 to the high pressure containers along high pressure conduit 440, the PLC 470 may be activated (start step 501). The PLC 470 has been inputted with the first, second and third set points. Manual valve 408 is normally kept in an open position. PLC 470 sends a signal (e.g., wireless signal, hard wiring signal or pneumatic gas) to control valve 429 as well as isolation valve 407 and 413 thereby causing the valves 407, 429 and 413 to set into the open position. CO2 vapor 471 from source vessel 473 flows along vapor supply conduit 477 and through open control valve 429, 407 and 413 to occupy the fill manifold 474 and high pressure conduit 440 extending up to the high pressure containers. The control valve 429 closes when a predetermined vapor fill time has been reached (e.g., about 5-10 seconds) to achieve an isolated amount of CO2 vapor within the fill manifold 474 and high pressure conduit 440, which extends up to the containers, for conducting the pre-fill integrity checks. Alternatively, the fill of CO2 vapor can be based upon reaching a certain pressure in the fill manifold 474, and high pressure conduit 440 up to the containers, before closing the control valve 429.

The pressure in the fill manifold 474 and high pressure conduit 440 extending up to high pressure containers can be measured by one or more of several pressure transducers, including pressure transducer 403 in liquid supply conduit 478; and pressure transducer 412 positioned downstream of flow meter 410. The pressure transducers 403 and 412 continuously monitor the pressure in the various conduits during the pre-fill integrity checks. Signals associated with each of the pressure transducers 403 and 412 are transmitted to PLC 470, which calculates whether the fill manifold 474 and high pressure fill conduit 440 extending up to high pressure containers have undergone a pressure change or drop during a certain time period (e.g., 30 sec) as indicated in step 503. Having calculated the pressure change, the PLC 470 determines whether the pressure change in the fill manifold 474 and the high pressure conduit 440 up to the containers, if any, is less than the first set point (step 504). Additionally, the PLC 470 checks whether the pressures are higher than the predetermined lower pressure of the CO2 vapor (e.g., higher than 61 psig), and lower than the predetermined upper pressure of the CO2 vapor in the fill manifold 474 (step 504) (e.g., 300-350 psig).

Should the PLC 470 determine that the fill manifold 474 and high pressure conduit 440 extending up to the high pressure containers has (i) a leak equal to or higher than the first set point; or (ii) a pressure below the predetermined lower pressure (second set point); or (iii) a pressure above the predetermined upper pressure (third set point), then the PLC 470 prevents subsequent filling of CO2 liquid 472 from source vessel 473 into high pressure container (step 505) and displays an alarm for troubleshooting. Next, the control methodology 500 allows a technician to determine whether the system 400 of FIG. 4 has a leak (step 506). If a leak is determined along any of the various conduits inside the confined area where the containers are located or a leak is determined by virtue of the high pressure containers not connected to their respective conduit, then a technician fixes the leak (step 507). A leak may occur, by way of example, as a result of the containers not connected to the fill box though which high pressure conduit 440 communicates with the containers located inside a building or other confined area. If no leak is detected, the pressurization of the system has likely failed as a result of CO2 vapor in fill manifold 474 flowing along conduit 440 and into containers as a result of the containers depleted to a point that the containers have a container pressure less than the pressure in the fill manifold 474 and high pressure conduit 440. As such, the high pressure containers are checked to determine whether they are depleted to a level where the pressure in the container is 61 psig or less (step 508). If such condition is verified, then the system 400 proceeds to fill such container with CO2 vapor until the pressure in the container is at least 61 psig or slightly higher (step 509). In this manner, the fill manifold 474, high pressure conduit 440 and containers are above a predetermined lower pressure at which the onset of dry ice formation is avoided during the subsequent filling of CO2 liquid.

When the leak checks and pressurization criteria are met, the control methodology 500 is designed to allow filling of liquid CO2 to begin. Manual valve 401 is for maintenance purposes preferably kept normally in the open position. Three-way automated valve 411 is normally closed towards liquid supply conduit 478 but normally open towards valve 420 and 111. Three-way automated valve 411 receives a signal from PLC 470 that causes it to open towards liquid supply conduit 478. Pump 402 may be primed prior to the liquid CO2 fill of high pressure containers by circulating liquid CO2 back to source vessel/tank 473 via valve 429. The PLC 470 sends signals to the other control valve 407 along the liquid supply conduit 478 and control valve 413 along high pressure conduit 440 to cause each to open. CO2 liquid 472 can be withdrawn from source vessel 473 and then pressurized by pump 402 as it flows along liquid supply conduit 478, high pressure conduit 440 and then into a high pressure container at the customer site (step 510).

The PLC 470 can be inputted with a predetermined lower flow rate; a predetermined upper flow rate; predetermined lower fill pressure and a predetermined maximum fill time. As filling into container occurs, the filling process is monitored as set forth in step 511. The CO2 liquid is introduced when the PLC 470 determines that the (i) fill pressure (as measured by pressure transducers 403 and 412 with corresponding signals sent back to PLC 470) is greater than the predetermined lower pressure to avoid leakage occurring during fill; (ii) the flow rate (as measured by flow meter 410 with corresponding signal fed back to PLC 470) is greater than the predetermined lower flow rate to ensure there is no blockage in the conduit or any other problem; (iii) the flow rate (as measured by flow meter 410 with corresponding signal fed back to PLC 470) is less than the upper flow rate to ensure there is no problem such as unexpected high pump speed due to higher motor speed; and (iv) the fill time does not exceed the predetermined maximum fill time (as may occur if the cylinder is not receiving CO2 liquid). If all of the conditions in step 511 are met, the filling continues to completion until the PLC 470 determines that container increases to a predetermined container pressure (i.e., fill pressure), at which point the PLC 470 sends a signal to pump 402 to automatically shut down, and the three-way valve 411, which is open towards pump 402, closes so that filling is stopped (step 512). The fill manifold 474 and the high pressure conduit 440 which, includes the line extending from quick connector 430 up to the shuttle valve 4 (FIGS. 1*a*, 1*b* and 1*c*) between high pressure containers 1 and 2) are vented (step 513) and all the automated valves in the system 400 return to their normal position and PLC 470 returns to its main screen and is ready for the next fill (step 514). With regards to venting, as the pressure in the fill manifold 474 is higher than the source vessel 473 after completion of filling, valve 429 is open to release the high pressure CO2 through valve 429 to allow CO2 to return into source vessel 473. When equilibrium pressure is reached, the second vent step can occur to close valve 429 and open valve 430 to vent any remaining CO2 to the atmosphere.

Should one or more of the filling conditions not meet required set points at step 511 as determined by the PLC 470, which compares its inputted set points with corresponding fill conditions, then the filling operation is automatically terminated and a corresponding display message and/or alarm may appear on the display panel of the PLC 470 indicating a need to troubleshoot (step 515). After the issues are fixed, step 501 is started to re-initiate the integrity pre-fill checks.

In another example, pre-fill integrity checks and filling may occur for a low pressure system where filling of CO2 liquid occurs into a container such as an insulated microbulk container that can handle pressures less than 350 psig, such as, by way of example, 200-300 psig. System 400 is configured to fill through low pressure conduit 450 having quick-connect conduit 428 connected to the low pressure containers as shown in FIG. 4. Unlike a high pressure, 2-cylinder system of FIG. 1*a*, which has a shuttle valve 4 and check valve configuration that prevents the reversible flow of CO2 vapor from the high pressure container back to the high pressure fill conduit 440, the insulated microbulk container generally does not have any check valve, so that the vapor CO2 from the microbulk can flow back into the fill manifold 474 and can serve as the source of vapor CO2 for the pre-fill leak check on the low pressure conduit 450 and pressure check on the microbulk, as described hereinbefore. The steps of control methodology 500 remain the same for the pre-filling integrity checks and subsequent filling for the low pressure system. When the CO2 source is from vapor CO2 in the microbulk, as opposed to vapor CO2 471 in source vessel 473, then a signal is sent to control valve 421 to cause it to open to allow CO2 vapor flow from the microbulk container via valve 407 into liquid supply conduit 479 of fill manifold 474. Isolation valve 420 can be configured as an automated valve and the liquid supply conduit 479 may be used for automated gravity fill. Alternatively, source vessel 473 can supply the CO2 vapor 472 through valve 429 and fill the microbulk container with vapor CO2 prior to fill with liquid CO2 when the microbulk container does not have enough CO2 vapor (e.g., less than 61 psig).

Other variations and additional features are contemplated. For example, the present invention can manually perform the pre-fill integrity checks if desired. In such a scenario, manual valve 117 would open as opposed to control valve 429. Additionally, valve 420 may be configured as manual valve and the filling of CO2 liquid into low pressure containers can occur by free flow from source vessel 473 by opening manual valve 420. No pump 4 is required. CO2 liquid 472 is withdrawn from source vessel 473 and free flows into liquid supply conduit 479 and then travels pass flow meter 410 and downwards through open valve 122 and into low pressure conduit 450. Still further, a manual mode can allow an end-user to operate any automated valve of FIG. 4.

A discharge pressure control device 428 which is set higher than the predetermined fill pressure but lower than the pressure rating of the high pressure fill system can be employed. The discharge pressure control device 428 opens when the pressure reaches its set value which returns the excess liquid CO2 to source vessel 473 when the pressure in fill manifold 474 and high pressure conduit 440, extending up to the containers, reaches the predetermined fill pressure but the pump 402 has not stopped. The PLC controller 402 can also be programmed to release the excess liquid CO2 to source vessel 473 via valve 429. Still further, as a means to further enhance safety during filling at step 511, the value of pressure relief devices shown in FIG. 4 (e.g., pressure relief devices 406, 409, 414 and 418 for filling of the high pressure system) can be set to a lower value than the value of the pressure relief devices on the high pressure containers installed inside the customer building. If the system 400 encountered error with higher pressures, the pressure relief devices along the fill manifold 474 releases, thereby reducing the risk of releasing of CO2 inside. As an example, the pressure relief devices 406, 409, 414 and 418 are set at 1500 psig, while the pressure relief devices on the high pressure containers are set at a value higher than 1500 psig, such as 1600 psig. Furthermore, the discharge pressure control device 428 may be set at a lower value than the value of pressure relief devices 406, 409, 414 and 418 (e.g. 1400 psig), thereby directing excess CO2 back to source vessel 473 instead of releasing CO2 to the atmosphere when the system is overpressurized. In this manner, a safe means can be implemented for recovering excess CO2 liquid or vapor.

Still further, pressure gauges 405, 419 and 427 can be used for local observation during the pre-filling and filling operations.

The PLC 470 may be inputted with various values for the set points when performing the pre-fill integrity checks. In one example, the first set point is about 5 psig or less; the second set point is about 61 psig; the third set point is about 350 psig or higher. With regards to the filling operation, the PLC may also be inputted with various values. In one example, the predetermined lower flow rate is 10 pounds per minute (lbpm); the predetermined upper flow rate is about 40 lbpm; the predetermined maximum fill time is about 7 minute; and the predetermined pressure into the container at completion of filling is about 1200 psig (i.e., filling stops when fill pressure has reached about 1200 psig).

It should be understood that system 400 represents one type of system for carrying out the pre-fill integrity checks in accordance with the present invention. The control methodology 500 contemplates other types of flow, valving and instrumentation configurations for carrying out the pre-fill integrity checks of the invention. For example, the pneumatic control valves can be replaced with solenoid valves. Still further, a single supply conduit for CO2 liquid filling can be used when filling into either low pressure or high pressure containers. Additionally, other values for set points can be used to carry out the pre-fill integrity checks. For example, the predetermined lower pressure limit may be inputted into the PLC 470 as 100 psig to ensure there is enough of a safety cushion on the lower pressure operating regime that ensures the formation of dry ice in the fill manifold 474 and all conduits, including conduits 440 and 450, is avoided.

Although the embodiments have been described in connection with onsite filling at a customer site, it should be understood that the process and associated control methodology of the present invention is applicable to CO2 filling at a plant. Further, the control methodology and pre-fill integrity checks can be applied to other fluids besides CO2. In particular, the present invention is particularly suitable for fluid fill processes where the receiving containers are located in a place where the operator conducting the filling has no visibility of the receiving containers. Still further, although the embodiments have described pressure-based filling, it should be understood that the methodology described herein may be used for filling based on weight. A scale can be employed for the weight fill and the signal form the scale can transmitted to controller 470.

The present invention avoids many of the problems encountered when filling CO2 liquid into containers located inside a building or other confined area on a customer site that are not visible when operating a CO2 liquid filling system, such as inadvertent release of CO2 liquid into the confined area as a result of the containers not connected to the fill hose or leakage of the conduit between the fill box and containers. Further, the present invention ensures dry ice formation is avoided during filling by ensuring the fill manifold and containers are above 61 psig.

The invention claimed is:

1. A CO2 safety interlock fill system configured to perform pre-fill integrity checks for automatically leak checking a fill manifold and pressurizing the fill manifold, said pre-fill integrity checks for the leak checking and the pressurizing of the fill manifold performed prior to the CO2 safety interlock fill system allowing a subsequent filling operation of liquefied carbon dioxide (CO2) product into a container from an onsite CO2 source, said CO2 safety interlock fill system comprising:

the onsite CO2 source, said onsite CO2 source comprising a source vessel containing liquefied CO2, and vaporized CO2 in a headspace of the source vessel;

a fill manifold operably connected to the source vessel, said fill manifold comprising one or more conduits positioned between the source vessel and the container, said one or more conduits comprising at least a CO2 vapor supply conduit extending into the headspace of the source vessel of the onsite CO2 source;

said fill manifold further comprising at least one pressure transducer situated along the one or more conduits, said CO2 vapor supply conduit of the fill manifold configured to receive a finite amount of the vaporized CO2 during the pressurization and leak checking of the fill manifold, said CO2 vapor supply conduit receiving the vaporized CO2 from the headspace of the source vessel of the onsite CO2 source;

a controller in communication with the fill manifold and the at least one pressure transducer to automatically perform the leak checking of the fill manifold and the pressurization of the fill manifold, the controller having as a first input a first set point value equal to a value indicative of an unallowable change in reduction in pressure of the vaporized CO2 in the fill manifold during a predetermined time period that the leak checking occurs, and further wherein the controller has a second set point value equal to a lower value indicative of a predetermined lower pressure of the vaporized CO2 in the fill manifold below which dry ice may form and a third set point value equal to an upper value indicative of a predetermined upper pressure of the vaporized CO2 above which reversible flow of CO2 vapor may occur from the container into the fill manifold;

wherein the controller is configured to receive signals corresponding to real-time pressure measurements from the pressure transducer during the predetermined time period of the leak check and/or the pressurization of the fill manifold;

said controller configured to prevent the subsequent filling operation when one or more of the real-time pressure measurements (i) has changed in pressure by an amount that is equal to or higher than the first set point value of the unallowable change in reduction in pressure of the vaporized CO2 in the fill manifold, or (ii) the one or more of the real-time pressure measurements is lower than the lower value indicative of the predetermined lower pressure at which dry ice forms, or (iii) the one or more of the real-time pressure measurements is greater than the upper value indicative of the predetermined upper pressure at which reversible flow of CO2 vapor may occur from the container into the fill manifold; and said controller is configured to allow the subsequent filling operation when each of (i) the one or more of the real-time pressure measurements has change in pressure by an amount that is less than the first set point value of the unallowable change in reduction in pressure of the vaporized CO2 in the manifold, and (ii) the one or more of the real-time pressure measurements is equal to or above the lower value indicative of the predetermined lower pressure at which dry ice forms, and (iii) the one or more real-time pressure measurements is equal to or lower than the upper value indicative of a predetermined upper pressure at which reversible flow of CO2 vapor may occur from the container into the fill manifold.

2. The CO2 safety interlock fill system of claim 1, further comprising a pump situated along the one or more conduits of the fill manifold.

3. The CO2 safety interlock fill system of claim 1, wherein the one or more conduits comprises a high pressure conduit and a low pressure conduit, each of the high pressure conduit and the low pressure conduits operably connected to the CO2 vapor supply conduit, and further wherein the high pressure conduit is operably connected to the container and the low pressure conduit is operably connected to a low pressure container.

4. The CO2 safety interlock fill system of claim 1, wherein the onsite CO2 source is self-powered such that no external electric power or other external utilities are needed to operate the pre-fill integrity checks of the CO2 safety interlock fill system.

5. The CO2 safety interlock fill system of claim 1, further comprising a control valve situated along the CO2 vapor supply conduit, said control valve in communication with the controller.

6. The CO2 safety interlock fill system of claim 1, wherein the on-site CO2 source, the fill manifold and the controller are mounted on a transportable vehicle when performing said pre-fill integrity checks.

7. A method of performing pre-fill integrity checks for automatically leak checking a fill manifold and pressurizing the fill manifold, comprising:

introducing a finite amount of vaporized CO2 into a fill manifold operably connected to a source vessel of an onsite CO2 source, said fill manifold comprising a CO2 vapor supply conduit, said CO2 vapor supply conduit having a first end and a second end, the first end extending into a headspace of the source vessel of the onsite CO2 source, the second end extending towards a container;

inputting a first set point value into a controller in communication with the fill manifold, said first set point value equal to a value indicative of an unallowable change in reduction in pressure of the vaporized CO2 introduced into the fill manifold;

inputting a second set point value into the controller, said second set point value equal to a lower value indicative of a predetermined lower pressure of the vaporized CO2 in the fill manifold, said lower value indicative of the predetermined lower pressure being a pressure at which an onset of dry ice formation in the fill manifold can occur;

inputting a third set point value into the controller, said third set point value equal to an upper value indicative of a predetermined upper pressure of the vaporized CO2 in the fill manifold above which reversible flow of CO2 vapor may occur from the container into the fill manifold;

measuring the real-time pressures in the fill manifold and generating signals corresponding to each of the real-time pressures;

transmitting the signals to the controller operably connected to the fill manifold;

determining the pre-fill integrity checks, such that either (a) one or more of the real-time pressures (i) has changed in pressure by an amount that is equal to or higher than the first set point value, or (ii) is equal to or lower than the second set point value, or (iii) is greater than the third set point value; and in response thereto preventing a subsequent filling of CO2 liquid from the onsite CO2 source to the container along the fill manifold; or (b) one or more of the real-time pressure measurements (i) has changed in pressure by an amount that is less than the first set point value, and (ii) is above the second set point value, and (iii) is lower than the third set point value; and in response thereto allowing the subsequent filling of the CO2 liquid from the onsite CO2 source to the container along the fill manifold.

8. The method of claim 7, wherein the pre-fill integrity checks are determined by the controller to fail in accordance with (a).

9. The method of claim 8, wherein the pre-fill integrity checks fail in accordance with (a)(i).

10. The method of claim 8, wherein the pre-fill integrity checks fail in accordance with (a)(ii).

11. The method of claim 8, wherein the pre-fill integrity checks fail in accordance with (a)(iii).

12. The method of claim 7, wherein the pre-fill integrity checks are determined by the controller to pass in accordance with (b).

13. The method of claim 12, further comprising:

the controller transmitting a signal to a control valve positioned along a liquid supply CO2 conduit of the fill manifold to configure the control valve into an open position to allow a flow of the CO2 liquid therealong; and pressurizing the CO2 liquid withdrawn from the onsite CO2 source to form pressurized CO2 liquid.

14. The method of claim 13, further comprising:

flowing the pressurized CO2 liquid along the liquid supply CO2 conduit of the fill manifold; and introducing the pressurized CO2 liquid into a liquid CO2 container, said CO2 container operatively connected with a vapor CO2 container.

15. The method of claim 7, further comprising:

determining the pre-fill integrity checks to pass in accordance with (b);

configuring the fill manifold to enable the subsequent filling of CO2 liquid from the onsite CO2 source to the container along the fill manifold;

wherein the step of configuring includes transmitting a signal from the controller to cause a control valve positioned along a liquid supply CO2 conduit to open;

withdrawing the CO2 liquid from the source vessel of the onsite CO2 source into the liquid supply CO2 conduit of the fill manifold; and flowing the CO2 liquid along the liquid supply CO2 conduit.

16. The method of claim 15, further comprising:

inputting a fourth set point value into the controller, said fourth set point value equal to a lower flow rate value indicative of a predetermined lower flow rate;

inputting a fifth set point value into the controller, said fifth set point value equal to an upper flow rate value indicative of a predetermined upper flow rate;

inputting a sixth set point value into the controller, said sixth set point value equal to a predetermined maximum fill time;

pressurizing the CO2 liquid to a fill pressure;

introducing the CO2 liquid into the container at a flow rate; and terminating the introducing of the CO2 liquid into the container when the controller determines (i) the fill pressure is less than a predetermined minimum pressure; or (ii) the flow rate is less than the fourth set point value; or (iii) the flow rate is greater than the fifth set point value; or (iv) the fill time exceeds the sixth set point value.

17. The method of claim 15, further comprising:

inputting a fourth set point value into the controller, said fourth set point value equal to a lower flow rate value indicative of a predetermined lower flow rate;

inputting a fifth set point value into the controller, said fifth set point value equal to an upper flow rate value indicative of a predetermined upper flow rate;

inputting a sixth set point value into the controller, said sixth set point value equal to a predetermined maximum fill time;

inputting a seventh set point value into the controller, said seventh set point value equal to a predetermined container pressure;

pressurizing the CO2 liquid to a fill pressure;

introducing the CO2 liquid into the container at a flow rate to increase a pressure of the container when the controller determines (i) the fill pressure is greater than the second set point value; and (ii) the flow rate is greater than the fourth set point value; and (iii) the flow rate is less than the fifth set point value; and (iv) the fill time does not exceed the sixth set point value.

18. The method of claim 17, further comprising:

measuring a real-time pressure of the container;

transmitting a signal corresponding to the real-time pressure to the controller;

automatically stopping the introducing of the liquid CO2 into the container when the real-time pressure is determined by the controller to increase to the predetermined container pressure.

19. The method of claim 16, further comprising performing the-pre-fill integrity checks until the pre-fill integrity checks are determined by the controller to pass in accordance with (b).

20. The method of claim 17, wherein the first set point value is about 5 psig or less, the second set point value is about 61 psig, the third set point value is about 350 psig or higher, the fourth set point value is 10 pounds per minute, the fifth set point value is about 40 pounds per minute, the sixth set point value is about 3-5 minutes and the seventh set point value is 1200 psig.

21. The method of claim 7, further comprising:

determining the pre-fill integrity check to fail under (a)(ii); and then determining the one or more of the real-time pressure measurements has changed in pressure by an amount that is less than the first set point value and is equal to or below the second set point value; and filling the container with CO2 vapor to a pressure above the second set point value.

* * * * *